US007668473B2

(12) United States Patent
Nakajima et al.

(10) Patent No.: US 7,668,473 B2
(45) Date of Patent: Feb. 23, 2010

(54) FIXING DEVICE AND IMAGE FORMING APPARATUS

(75) Inventors: Tomoki Nakajima, Yamatokoriyama (JP); Tamaki Mashiba, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 347 days.

(21) Appl. No.: 11/892,599

(22) Filed: Aug. 24, 2007

(65) Prior Publication Data

US 2008/0050139 A1 Feb. 28, 2008

(30) Foreign Application Priority Data

Aug. 24, 2006 (JP) ..... 2006-228355
Dec. 28, 2006 (JP) ..... 2006-356213

(51) Int. Cl.
*G03G 15/20* (2006.01)

(52) U.S. Cl. ..... 399/69

(58) Field of Classification Search ..... 399/44, 399/69, 70, 328, 330, 335; 219/216, 469
See application file for complete search history.

(56) References Cited

U.S. PATENT DOCUMENTS 4,672,177 A * 6/1987 Headrick ..... 219/216
6,390,696 B1 * 5/2002 Concannon ..... 400/120.01
7,062,187 B2 * 6/2006 Peng et al. ..... 399/69
7,177,563 B2 * 2/2007 Sone et al. ..... 399/69
7,310,485 B2 * 12/2007 Peng et al. ..... 399/69
7,346,289 B2 * 3/2008 Tamaoki ..... 399/96
7,555,233 B2 * 6/2009 Shiobara et al. ..... 399/69
2007/0122173 A1 * 5/2007 Mitsuoka et al. ..... 399/69

FOREIGN PATENT DOCUMENTS

JP 10-300585 A 11/1998
JP 2000-227732 8/2000
JP 2001-109316 4/2001
JP 2003066760 A * 3/2003
JP 2004-151471 A 5/2004

* cited by examiner

*Primary Examiner*—Robert Beatty
(74) *Attorney, Agent, or Firm*—Nixon & Vanderhye, P.C.

(57) ABSTRACT

There are provided a fixing device and an image forming apparatus capable of reducing a sensing error of a surface temperature of a heating roller. The fixing device includes a temperature sensor for sensing the surface temperature of the heating roller, and a temperature calculation circuit. The temperature calculation circuit includes a noise removal prevention circuit. The temperature sensor includes an infrared ray sensing thermistor and a compensation thermistor, and the noise removal prevention circuit prevents removal of a part of an AC component (such as a high frequency component in a noise) included in a difference between outputs (difference output) of the infrared ray sensing thermistor and the compensation thermistor. Thus, the AC component is prevented from being offset when the difference outputs are averaged, thus reducing the sensing error of the surface temperature of the heating roller based on the average value of the difference outputs.

19 Claims, 17 Drawing Sheets

(Vd−Vc) <0.2

0.2≦ (Vd−Vc) <0.4

0.4≦ (Vd−Vc)

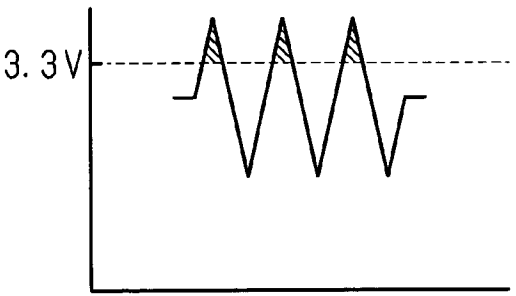
FIG. 17A
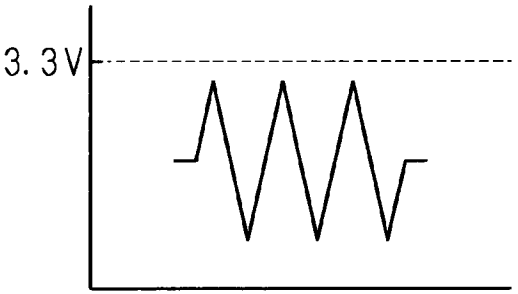
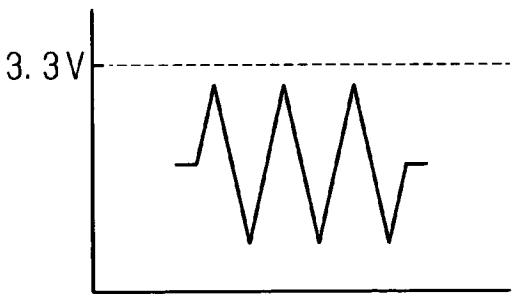
FIG. 17B
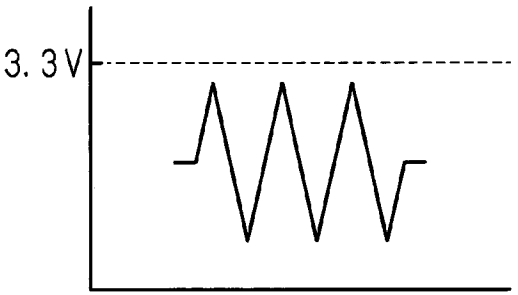
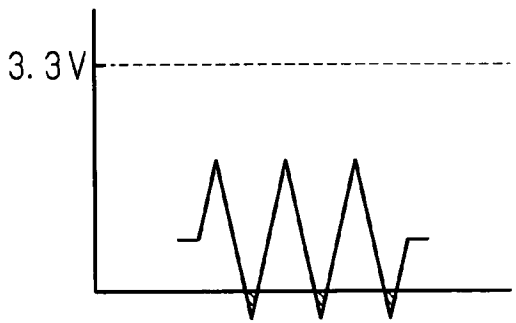
FIG. 17C
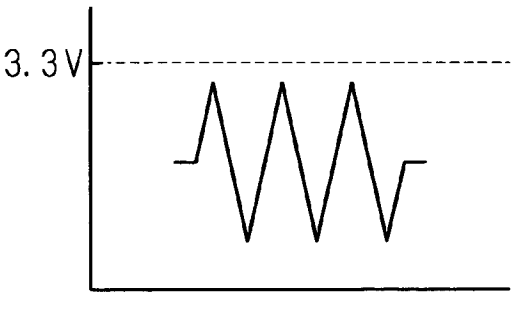

FIXING DEVICE AND IMAGE FORMING APPARATUS

CROSS-REFERENCE OF RELATED APPLICATIONS

This non-provisional application claims priority under 35 U.S.C. §119(a) on Patent Application No. 2006-356213 in Japan on Dec. 28, 2006 and Patent Application No. 2006-228355 in Japan on Aug. 24, 2006, the entire contents of which are hereby incorporated by reference.

BACKGROUND

1. Technical Field

The present invention relates to a fixing device capable of sensing a surface temperature of a heating roller, and an image forming apparatus including the fixing device.

2. Description of Related Art

In an image forming apparatus such as a copying machine and a printer device, a fixing device of a heating type is widely used to fix onto recording paper a toner image transferred to the recording paper. The fixing device of the heating type includes a heating roller having a heating unit such as a heater, and a pressurizing roller press-fitted to the heating roller, wherein recording paper having a toner image transferred thereon is passed through while sandwiched between the heating roller and the pressurizing roller, a toner on the recording paper is melted, and the toner image is fixed onto the recording paper by being further pressurized.

In such a fixing device, in order to surely melt the toner on the recording paper and prevent the recording paper from being adversely affected, a surface temperature of the heating roller needs to be accurately controlled. Therefore, conventionally, a plurality of thermistors are pressed against the surface of the heating roller, and temperatures of a center and an end of the surface of the heating roller are sensed to control power supply to a heater. Whereby, the surface temperature of an entire body of the heating roller is controlled to be uniformly maintained.

SUMMARY

However, when a surface temperature of a heating roller is accurately measured by using a thermistor, the thermistor needs to be pressed against the surface of the heating roller with a predetermined pressure. Therefore, a problem is involved therein that by continuously pressing the thermistor against one part of the heating roller, the surface of the heating roller is deteriorated due to friction between the thermistor and the surface of the heating roller, thus deteriorating fixing performance. Also involved therein is a problem that, when a stain on the surface of the heating roller is adhered to a surface of the thermistor, an accurate temperature cannot be sensed.

Therefore, in order to solve the above-described problems, there are proposed a fixing device and an image forming apparatus for sensing a surface temperature of a heating roller by an infrared ray sensor in a non-contact state. For example, there are proposed a fixing device and an image forming apparatus capable of accurately sensing a surface temperature of a heating roller by compensating for a temperature sensed by the infrared ray sensor based on a conforming emissivity signal according to an infrared ray emissivity of the heating roller, even when the infrared ray emissivity changes depending on difference in color or material (see Japanese Patent Application Laid-Open No. 2000-227732).

Further, there is proposed an image forming apparatus capable of sensing a temperature with high accuracy even when a surface color of a heating roller is different, by providing two areas having different infrared ray output characteristics in a predetermined area of the heating roller and sensing temperatures of these two areas by the infrared ray sensor (see Japanese Patent Application Laid-Open No. 2001-109316).

A temperature sensor of a non-contact type described in Japanese Patent Application Laid-Open No. 2000-227732 and Japanese Patent Application Laid-Open No. 2001-109316 functions to sense the surface temperature of the heating roller by sensing the infrared rays radiated from the surface of the heating roller, and includes an infrared ray sensing thermistor and a temperature compensation thermistor. Although the infrared ray sensing thermistor senses the infrared rays radiated from the surface of the heating roller, an output voltage thereof depends on an ambient temperature (namely, the temperature of the infrared ray sensing thermistor itself. In order to compensate for such a dependency on the temperature, the temperature of the infrared ray sensing thermistor itself needs to be sensed. Therefore, the temperature compensation thermistor is disposed near the infrared ray sensing thermistor and in a place not affected by the infrared rays radiated from the surface of the heating roller.

The temperature sensor is constituted so as to grasp an absolute temperature of the surface of the heating roller by sensing both end potentials of the two thermistors thus disposed. The temperature sensor converts an average value of differences between the both end potentials of the two thermistors into a digital value with an AD converter, and outputs the converted digital value to a CPU. By executing a predetermined program, the CPU obtains the surface temperature of the heating roller based on the inputted digital value or a table previously defined, and controls power supply of the heating roller.

However, when the difference between the both end potentials (potential difference) of each of the two thermistors is obtained, such a potential difference reaches a ground level in some cases. Namely, when an AC component (high frequency component) such as a noise is superimposed on a voltage indicating a voltage difference between the both end potentials of each of the two thermistors and the potential difference reaches the ground level, only a component of the superimposed noise not higher than the ground level is removed. Therefore, there is a risk that the average value of the potential differences between the both end potentials of the two thermistors becomes larger according to the removed component of not higher than the ground level, and the sensed temperature becomes higher than an actual temperature, thus making it impossible to accurately sense the surface temperature of the heating roller.

An object is to provide a fixing device capable of reducing a sensing error in a surface temperature of a heating roller with a simple structure, and an image forming apparatus including the fixing device.

In a first structure, a fixing device includes a heating roller and heats a sheet having an image transferred thereon by a developer to fix the image on the sheet. The fixing device further includes a first sensor for sensing radiation heat from the heating roller; a second sensor for sensing an ambient temperature of the first sensor; a calculation unit for calculating a difference between outputs of the first sensor and the second sensor; a removal prevention unit for preventing removal of an AC component included in the difference calculated by the calculation unit; and a sensing unit for sensing a surface temperature of the heating roller based on the difference calculated by the calculation unit.

The calculation unit (such as a calculation circuit) calculates the difference (such as (Vd−Vc)×α, wherein α is a constant) between an output (such as a voltage Vc) of the first sensor (such as an infrared ray sensing thermistor) that sensing the radiation heat from the heating roller, and an output (such as a voltage Vd) of the second sensor (such as a compensation thermistor) for sensing the ambient temperature of the first sensor. The removal prevention unit (such as a removal prevention circuit) prevents removal of the AC component (such as a noise having a high frequency component) superimposed on a DC component of the output (difference) of the calculation unit. For example, when the DC component in the output of the calculation unit is near the ground level, the component in the AC component of not higher than the ground level is prevented from being removed. Thus, when the surface temperature of the heating roller is obtained based on the average value of the outputs of the calculation unit, it is possible to suppress an increase in the average value due to the fact that only the component in the AC component set to be not higher than the ground level is removed (or only the component in the AC component set to be not lower than the ground level remains), and to prevent the surface temperature of the heating roller from being sensed higher than an actual surface temperature, thereby accurately sensing the surface temperature of the heating roller.

In a second structure, the fixing device includes an offset unit for preventing removal of the AC component by offsetting the DC component in the difference calculated by the calculation unit.

The offset unit (such as an offset circuit) offsets the DC component so as to prevent removal of the AC component superimposed on the DC component in the output (difference) of the calculation unit. For example, the offset unit offsets the DC component (apply bias of a predetermined value) so that the output (DC component) of the calculation unit does not reach the ground level, thereby making an output level higher than the ground level. Thus, even when the AC component is superimposed on the output of the calculation unit, the AC component is prevented from being removed by making a minimum value of the AC component not lower than the ground level.

In a third structure, the fixing device includes a subtraction unit for subtracting a predetermined value from the output of the first sensor, wherein the offset unit offsets the DC component by calculating by the calculation unit the difference between the output of the second sensor and the output subtracted by the subtraction unit.

The subtraction unit (such as a subtraction circuit) subtracts a predetermined value (such as a voltage Vb) from the output of the first sensor (such as a voltage Vc), and the calculation unit calculates a difference between the output of the second sensor (such as a voltage Vd) and the output of the subtraction unit (such as voltage Vc−Vb). In this case, the calculated difference is expressed as (Vd−Vc+Vb)×α(α is a constant). Thus, the DC component in the output of the calculation unit is made higher than the ground level by Vb×α. Even when no bias can be applied to the output of the second sensor (for example, when the output of the second sensor is in the vicinity of an increase/decrease limit value and an output value cannot be increased), the difference between the outputs of the first sensor and the second sensor outputted by the calculation unit can be made larger by applying bias to the output of the first sensor.

In a fourth structure, the fixing device includes an addition unit for adding a predetermined value to the output of the second sensor, wherein the offset unit offsets the DC component by calculating by the calculation unit the difference between the output added by the addition unit and the output of the first sensor.

The addition unit (such as an addition circuit) adds the predetermined value (such as a voltage Vb) to the output of the second sensor (such as a voltage Vd), and the calculation unit calculates the difference between the output of the addition unit (such as a voltage Vd+Vb) and the output of the first sensor (such as a voltage Vc). In this case, the calculated difference is expressed as (Vd−Vc+Vb)×α(α is a constant). Thus, the DC component in the output of the calculation unit is made higher than the ground level by Vb×α. Even when no bias can be applied to the output of the first sensor (for example, when the output of the first sensor is in the vicinity of the ground level and the output value cannot be reduced), by applying bias to the output of the second sensor, the difference between the outputs of the first sensor and the second sensor outputted by the calculation unit can be made larger.

In a fifth structure, the fixing device includes a control unit for controlling an increase/decrease in the DC component offset by the offset unit in accordance with a size of the difference calculated by the calculation unit.

The control unit controls the increase/decrease in the DC component offset by the offset unit in accordance with the size of the difference calculated by the calculation unit. For example, when the output (DC component) of the calculation unit is small, namely, when the DC component is near the ground level, the DC component is offset to be increased so that the AC component set to be not higher than the ground level in the AC component superimposed on the DC component is prevented from being removed. Thus, the DC component is prevented from reaching the ground level, and the minimum value of the AC component is made not lower than the ground level, to prevent the AC component from being removed. In addition, when the DC component is near a maximum amplifying voltage level, the DC component is offset to be decreased so that the AC component set to be not lower than the maximum amplifying voltage level in the AC component superimposed on the DC component is prevented from being removed. Thus, the DC component is prevented from reaching the maximum amplifying voltage level, and the maximum value of the AC component is set to be not higher than the maximum amplifying voltage level, to prevent the AC component from being removed.

In a sixth structure, the fixing device includes a plurality of offset units having different offset values for the DC component; and a selection unit for selecting one of the offset units according to the size of the difference calculated by the calculation unit, wherein the control unit controls the increase/decrease in the DC component by the offset unit selected by the selection unit.

The selection unit selects one of the offset units out of the plurality of offset units having the different offset values for the DC component according to the size of the difference calculated by the calculation unit, and the control unit controls the increase/decrease in the DC component by the selected offset unit. For example, when an output voltage of the first sensor is represented by Vc, an output voltage of the second sensor is represented by Vd, and a calculated difference is represented by (Vd−Vc), there are provided the offset units having the offset values for the difference (Vd−Vc) respectively set as Vb1, Vb2, and Vb3 (Vb1>Vb2>Vb3, such as Vb1=0.2 V, Vb2=0 V, and Vb3=−0.2 V). Namely, the difference is offset by one of the offset units to any one of Vd−Vc+Vb1, Vd−Vc+Vb2, and Vd−Vc+Vb3. Note that the offset values may be Vb1×α, Vb2×α, and Vb3×α, (α is a constant) instead of Vb1, Vb2, and Vb3.

When the difference (Vd−Vc) is large, namely, when the DC component is near the maximum amplifying voltage level, the control unit selects the offset unit having the offset value of Vb3 to offset the DC component to be decreased. Thus, the DC component is prevented from reaching the maximum amplifying voltage level, and the maximum value of the AC component is set to be not higher than the maximum amplifying voltage level, to prevent the AC component from being removed. Also, when the difference (Vd−Vc) is small, namely, when the DC component is near the ground level, the control unit selects the offset unit having the offset value of Vb1 to offset the DC component to be increased. Thus, the DC component is prevented from reaching the ground level, and the minimum value of the AC component is made not lower than the ground level, to prevent the AC component from being removed.

In a seventh structure, the fixing device includes a unit for calculating the average value of the differences calculated by the calculation unit, wherein the sensing unit senses the surface temperature of the heating roller based on the average value calculated by the unit.

The average value of the differences calculated by the calculation unit is calculated. The sensing unit senses the surface temperature of the heating roller based on the calculated average value, namely, the average value of the difference outputs (Vd−Vc)×α, and the output of the second sensor. In this case, the difference output can be calculated by removing an offset part from the difference calculated by the calculation unit. By calculating the average value of the differences, the AC component included in the differences is offset, and for example, by removing a part of the AC component, it is possible to prevent the difference output from becoming large.

In an eighth structure, the image forming apparatus includes the fixing device, wherein an image is formed by fixing the image onto a sheet by the fixing device.

The above description can be applied to the fixing device included in the image forming apparatus such as a printer device or a digital combined machine.

BRIEF DESCRIPTION OF DRAWINGS

FIGS. 17A to 17C are explanatory views showing examples of preventing removal of an AC component superimposed on a difference value.

DETAILED DESCRIPTION

First Embodiment

Figure 4:
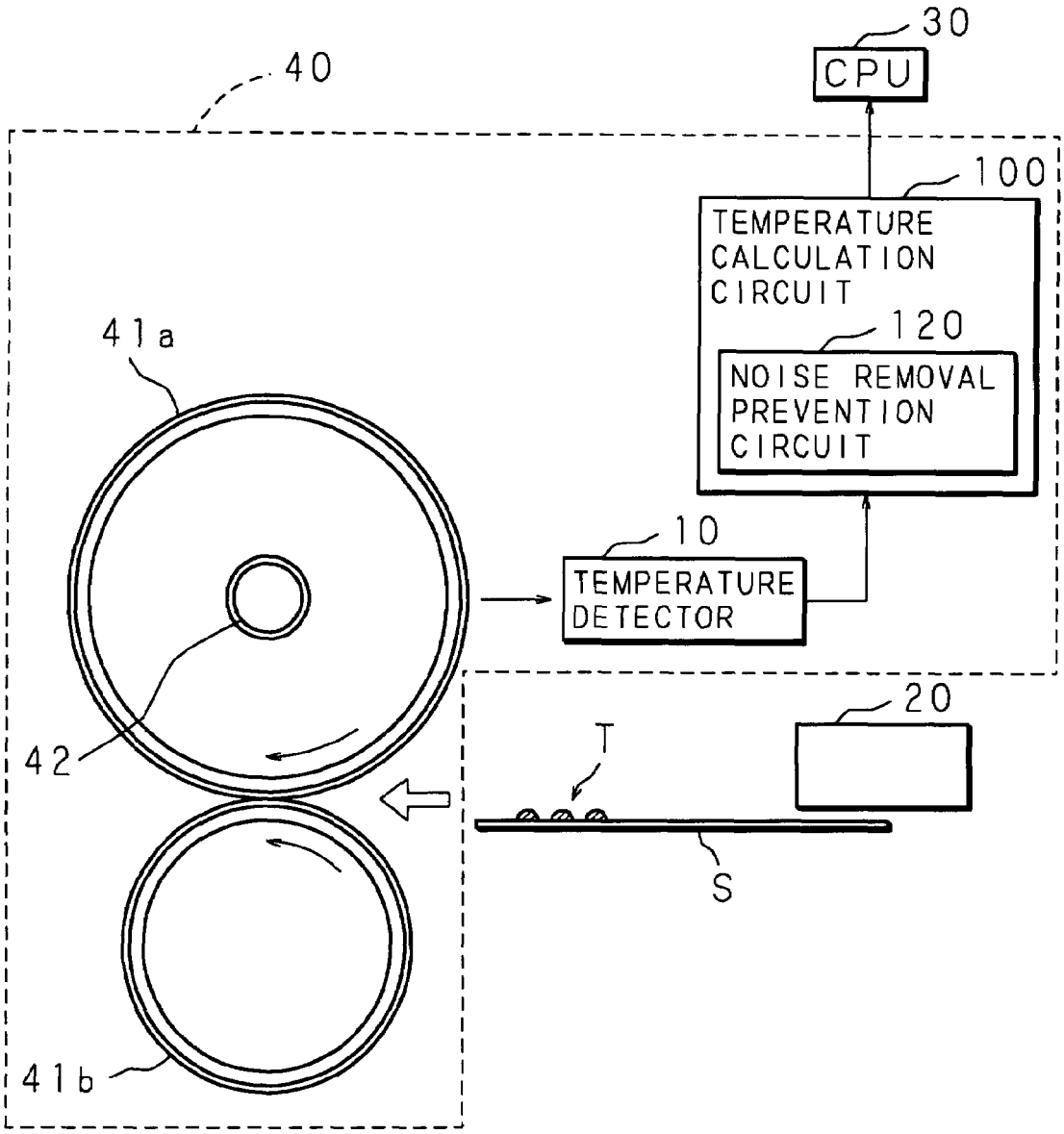
FIG. 4 is a schematic view showing an essential structure of a digital combined machine according to an embodiment.

As an example of a fixing device and an image forming apparatus including the fixing device, a digital combined machine will be explained hereunder based on the drawings showing embodiments. FIG. 4 is a schematic view showing an essential structure of the digital combined machine according to one embodiment. The digital combined machine forms an image by employing an electrophotographic system, and transfers with a transfer device 20 the image (toner image T) by a developer on a sheet S such as recording paper and an OHP film. The sheet S having the toner image T transferred thereon is carried along a predetermined carrying passage, and when the sheet S passes through a fixing device 40, the toner image T is fixed onto the sheet S by actions of a heating roller 41*a* and a pressurizing roller 41*b*. The sheet S having the toner image T fixed thereonto is further carried along the predetermined carrying passage, and is discharged to outside of the device.

The fixing device 40 includes the heating roller 41*a*, the pressurizing roller 41*b*, a heater 42, a temperature sensor 10 for sensing a surface temperature of the heating roller 41*a*, a temperature calculation circuit 100 for calculating the surface temperature of the heating roller 41*a*, and the like. The temperature calculation circuit 100 includes a noise removal prevention circuit 120 and the like. A calculation result of the temperature calculation circuit 100 is outputted to a CPU 30.

The heating roller 41*a* is formed by a hollow cylindrical metal core and a releasing layer formed outside thereof. The metal core is formed of metal such as iron, stainless steel, aluminum, or copper, or formed by an alloy of these metals, having a diameter of about 40 mm and a thickness of about 1.3 mm, for example. The releasing layer is formed by applying to the metal core fluorine resin such as PTA (tetrafluoroethylene-perfluoroalkylvinylether copolymer) and PTFE (politetrafluoroethilene) and synthetic resin such as silicone rubber and fluoro rubber, having a thickness of about 25 μm, for example.

The heater 42 as a heating unit is disposed inside the heating roller 41*a*. As the heater 42, for example, a stick-like halogen lamp can be used. The heater 42 emits light and radiates infrared rays, when power is supplied from outside. An inner peripheral surface (that is, an inner peripheral surface of the metal core) of the heating roller 41*a* is heated by the infrared rays radiated from the heater 42. The fixing device 40 maintains the surface temperature of the heating roller 41*a* to be substantially constant by controlling on/off of the heater 42.

The pressurizing roller 41*b* is disposed in contact with the heating roller 41*a* at an opposite side to the heating roller 41*a* across the carrying passage of the sheet S. The pressurizing roller 41*b* is formed by a hollow cylindrical metal core, a heat resistant elastic material layer formed outside this metal core, and a releasing layer formed further outside this layer. The metal core and the releasing layer are formed of the same material as that of the metal core and the releasing layer used in the heating roller 41*a*. In addition, silicone rubber and the like are used in the heat resistant elastic material layer, which is formed outside the metal core with a thickness of about 6 mm. An urging force of a predetermined magnitude is added to the pressurizing roller 41*b* in a direction of the heating roller 41*a* by an urging member (not shown) such as a pressurizing spring, and as a result, a fixing nip with a width of about 6 mm is formed at a press-fitted portion of the heating roller 41*a* and the pressurizing roller 41*b*.

The temperature sensor 10 is of a non-contact type and senses radiation heat (infrared ray) from the surface of the heating roller 41*a*. The structure of the temperature sensor 10 will be explained hereunder.

Figure 5:
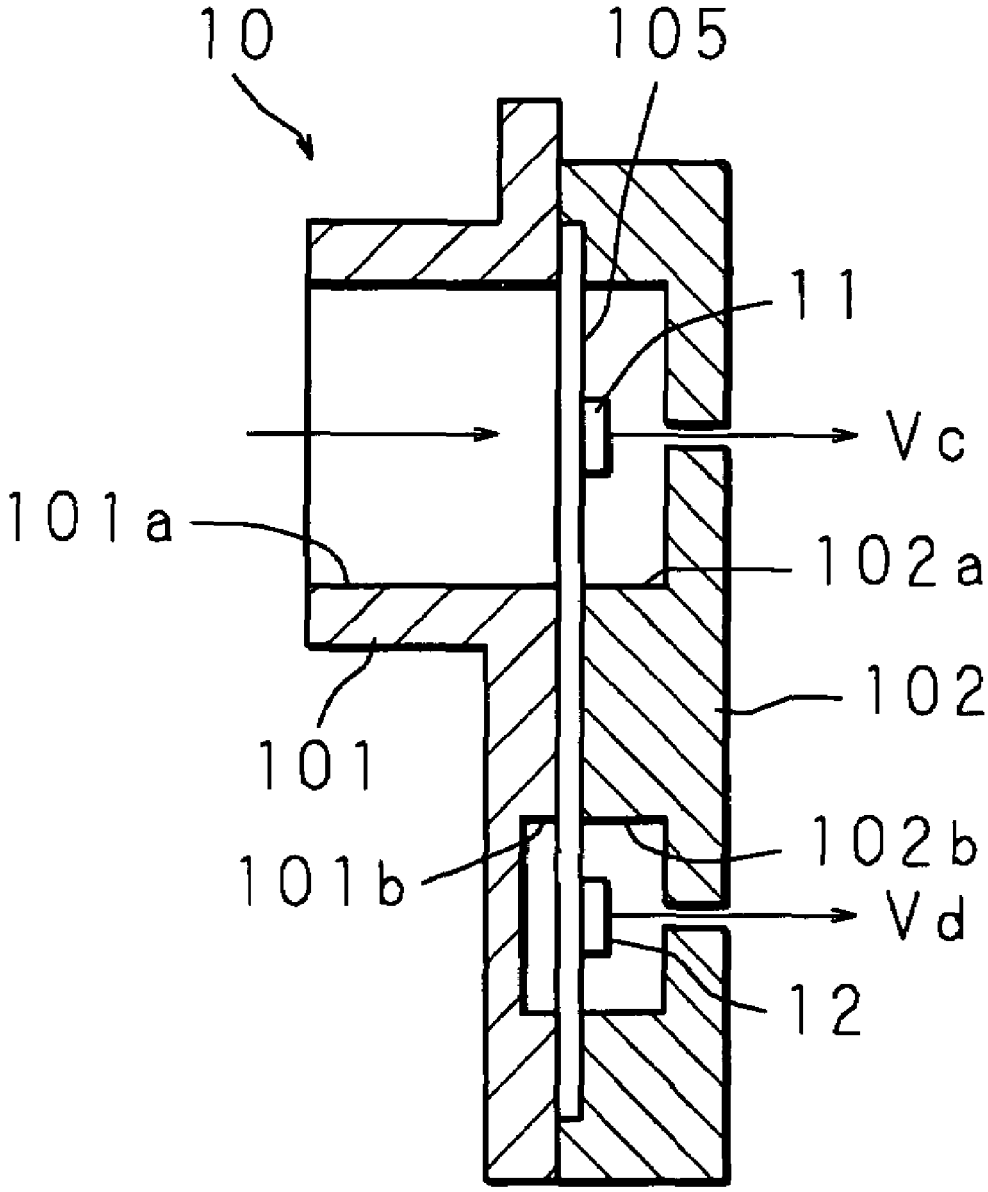
FIG. 5 is a sectional view showing a structure of a temperature sensor.

FIG. 5 is a sectional view showing the structure of the temperature sensor 10. The temperature sensor 10 includes an infrared ray sensing thermistor 11 and a compensation thermistor 12 inside a casing. The casing of the temperature sensor 10 is formed by a holding member 101 and a lid member 102. The holding member 101 and the lid member 102 are formed of metal such as aluminum having large heat conductivity and small thermal emissivity.

An opening part 101*a* is formed in the holding member 101, for allowing the infrared rays radiated from the heating roller 41*a* to pass through. A recess part 101*b* is formed with an adequate spacing from the opening part 101*a*. The lid member 102 is fitted to the holding member 101 with an infrared ray absorbent film 105 sandwiched therebetween. For example, a blackbody absorbent film can be used as the infrared ray absorbent film 105. The lid member 102 includes a space part 102*a* provided so as to face the opening part 101*a* in the holding member 101, and a space part 102*b* provided so as to face the recess part 101*b*.

The infrared ray sensing thermistor 11 is disposed on the infrared ray absorbent film 105 in a space partitioned by the infrared ray absorbent film 105 and the space part 102*a* in the lid member 102. The compensation thermistor 12 is disposed on the infrared ray absorbent film 105 in a space partitioned by the infrared ray absorbent film 105 and the space part 102*b* in the lid member 102.

When the infrared ray from the heating roller 41*a* is incident into the infrared ray absorbent film 105 through the opening part 101*a*, this infrared ray is absorbed into the infrared ray absorbent film 105. The temperature of the infrared ray absorbent film 105 is increased according to an amount of the absorbed infrared ray. The temperature of the infrared ray absorbent film 105 is sensed as a both end voltage Vc of the infrared ray sensing thermistor 11 disposed on the infrared ray absorbent film 105. However, since the infrared ray sensing thermistor 11 is influenced by an ambient temperature environment (such as the holding member 101 and the lid member 102), such an influence needs to be removed for sensing the surface temperature of the heating roller 41*a*. Therefore, the compensation thermistor 12 is disposed at a place not directly influenced by the infrared ray radiated from the heating roller 41*a*, and a both end voltage Vd of this compensation thermistor 12 is sensed, to thereby perform compensation of the infrared ray sensing thermistor 11. The fixing device 40 can sense the surface temperature of the heating roller 41*a* based on an output of the temperature sensor 10.

Figure 6:
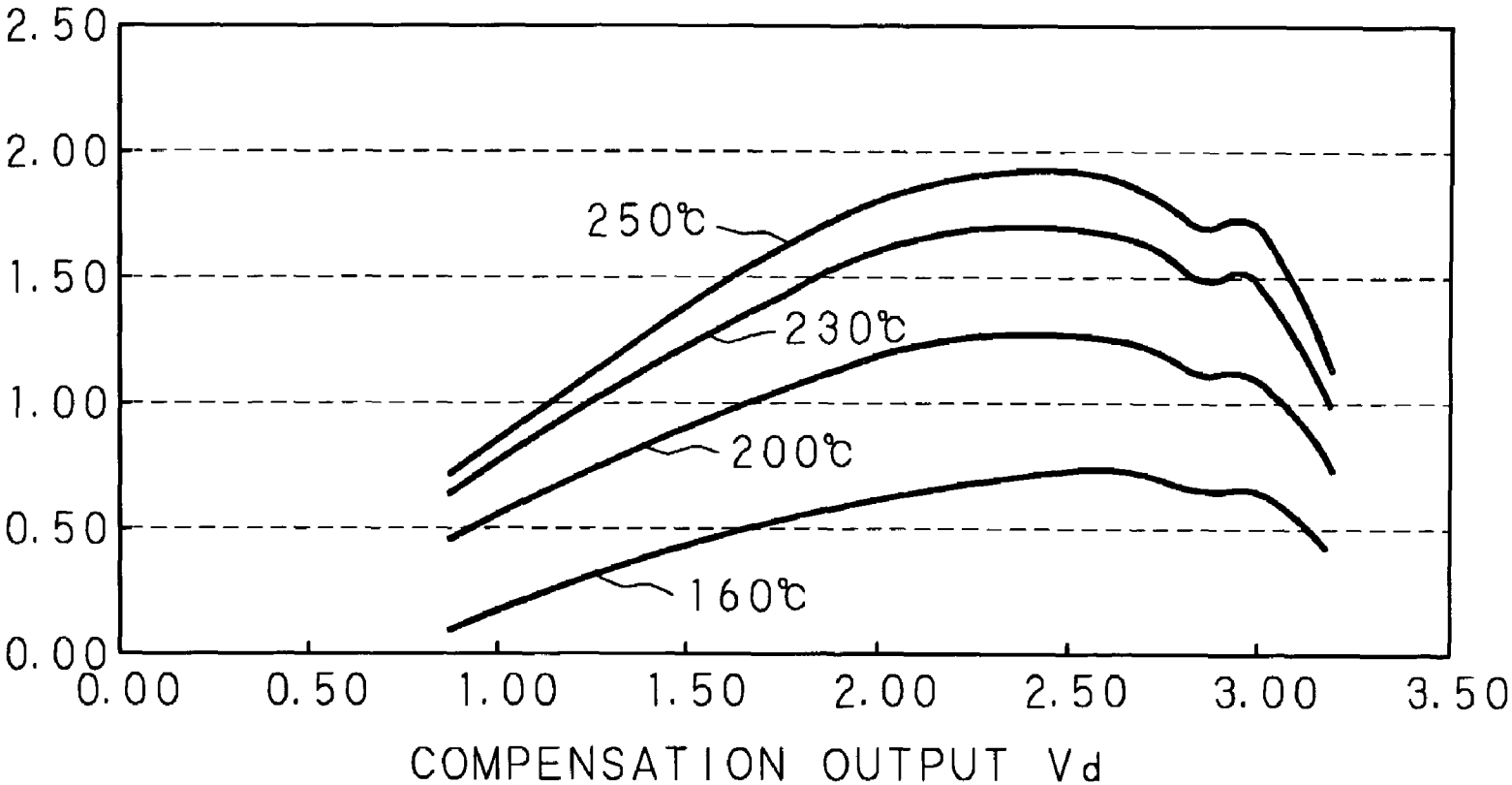
FIG. 6 is a graph showing a relation between an output of the temperature sensor and the surface temperature of the heating roller.

FIG. 6 is a graph showing a relation between the output of the temperature sensor 10 and the surface temperature of the heating roller 41*a*. The graph shows a compensated output Vd taken on an abscissa axis, the compensated output Vd as an output voltage of the compensation thermistor 12, and shows, taken on an ordinate axis, a value (referred to as a difference output hereunder) obtained by multiplying by 5 the difference between the compensated output Vd and a sensor output Vc as the output voltage of the infrared ray sensing thermistor 11. As shown in the drawing, the surface temperature of the heating roller 41*a* can be obtained by sensing the compensated output Vd and the difference output (Vd−Vc)×5. For example, when the compensated output is 1.6 V and the difference output is 0.5 V, the surface temperature of the heating roller 41*a* becomes 160° C. Similarly, when the compensated output is 1.6 V and the difference output is 1.0 V, the surface temperature of the heating roller 41*a* becomes 200° C., when the difference output is 1.25 V, the surface temperature of the heating roller 41*a* becomes 230° C., and when the difference output is 1.5 V, the surface temperature of the heating roller 41*a* becomes 250° C. Accordingly, a temperature conversion table is held in which relations among the compensated output Vd, the difference output (Vd−Vc)×5, and the surface temperature are digitized. When the compensated output Vd and the difference output (Vd−Vc)×5 are sensed, a corresponding surface temperature is read from the temperature conversion table, whereby the surface temperature of the heating roller 41*a* can be obtained.

However, when a surface temperature is read from the temperature conversion table by using the difference output (Vd−Vc)×5, an error of the difference output appears as an error of the surface temperature of the heating roller 41*a* in some cases.

Figure 1:
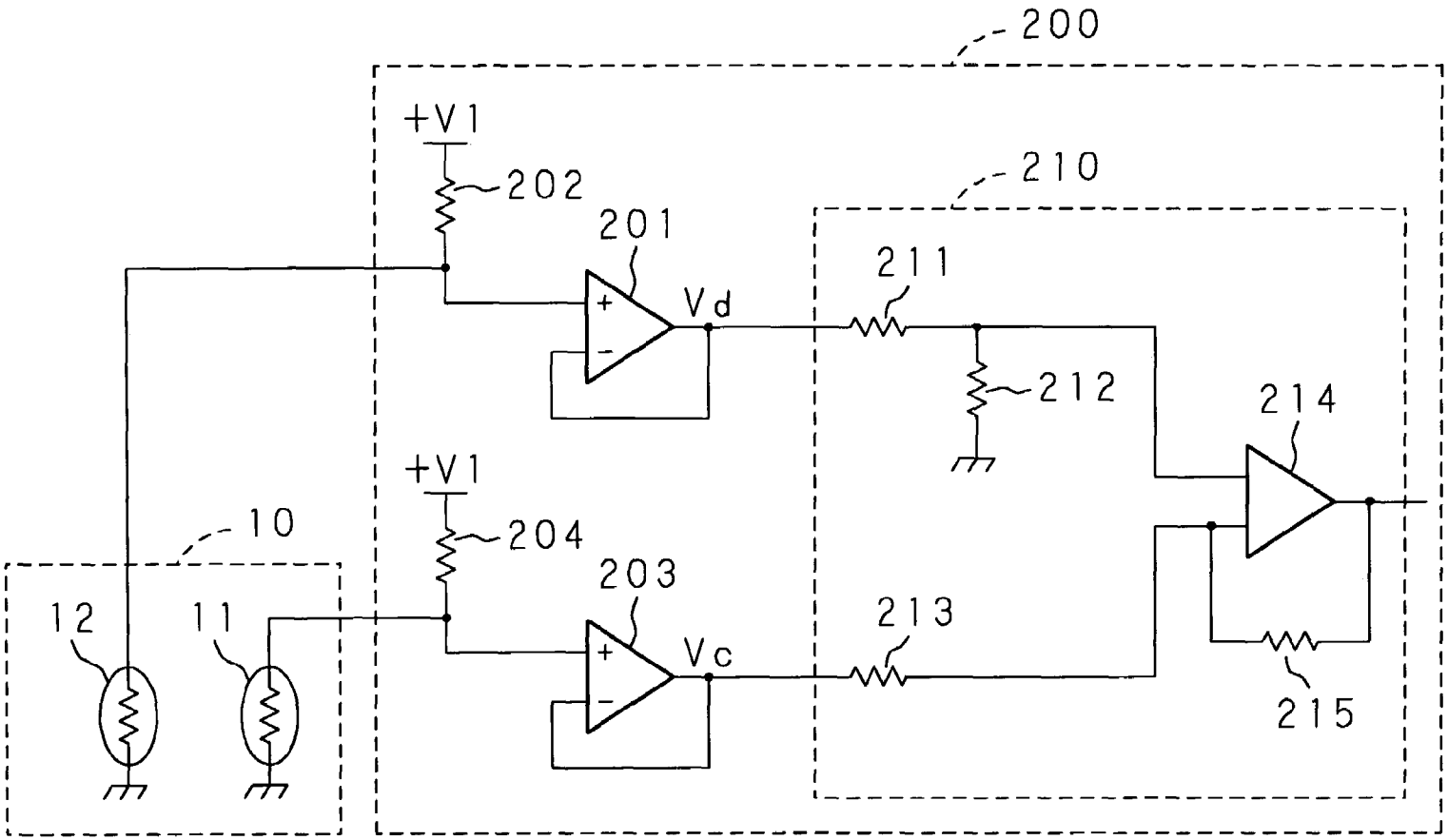
FIG. 1 RELATED ART
FIG. 1 is a circuit diagram showing an example of a conventional temperature calculation circuit.
Figure 2:
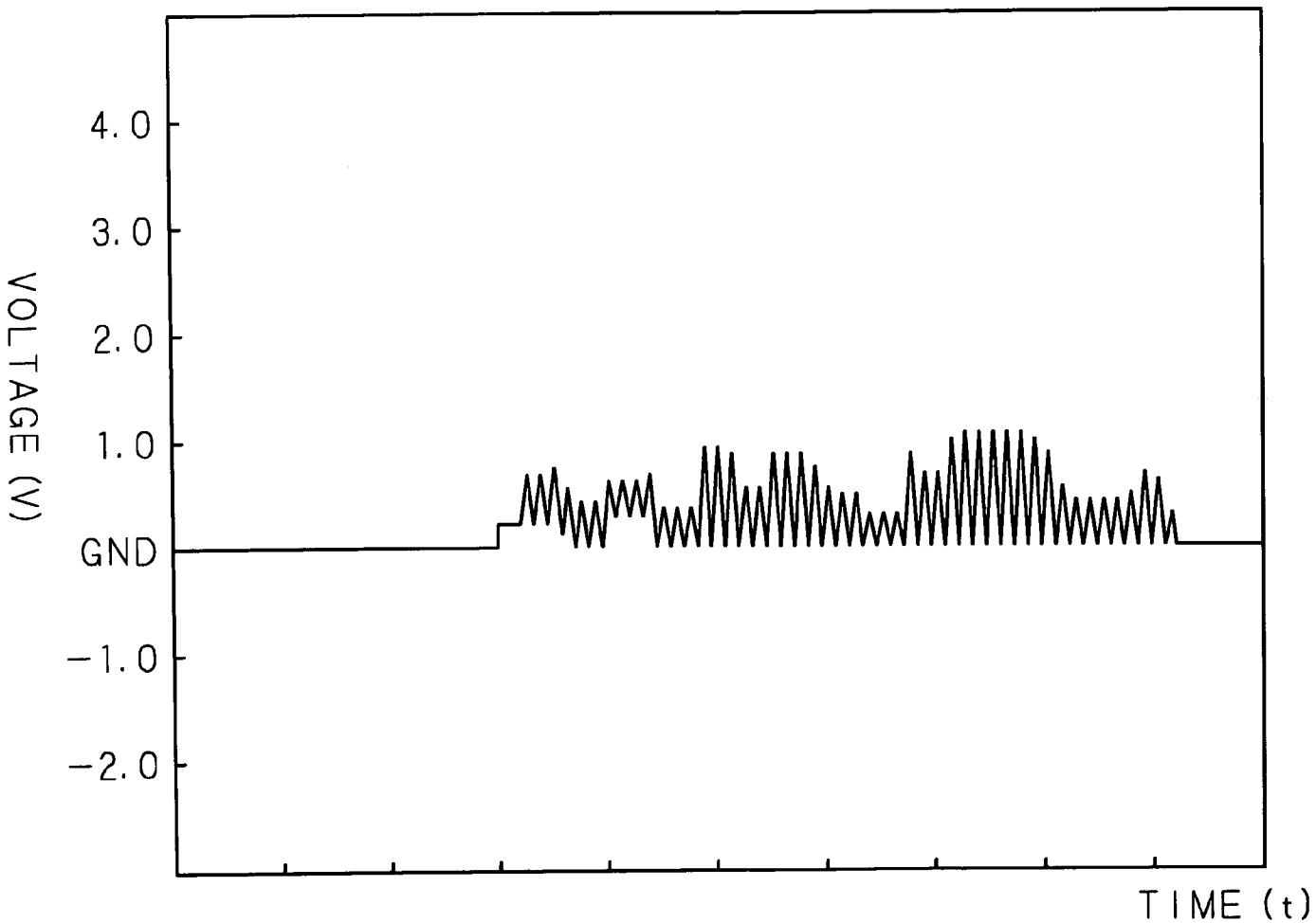
FIG. 2 RELATED ART
FIG. 2 is a view showing an example of a conventional difference output waveform.
Figure 3:
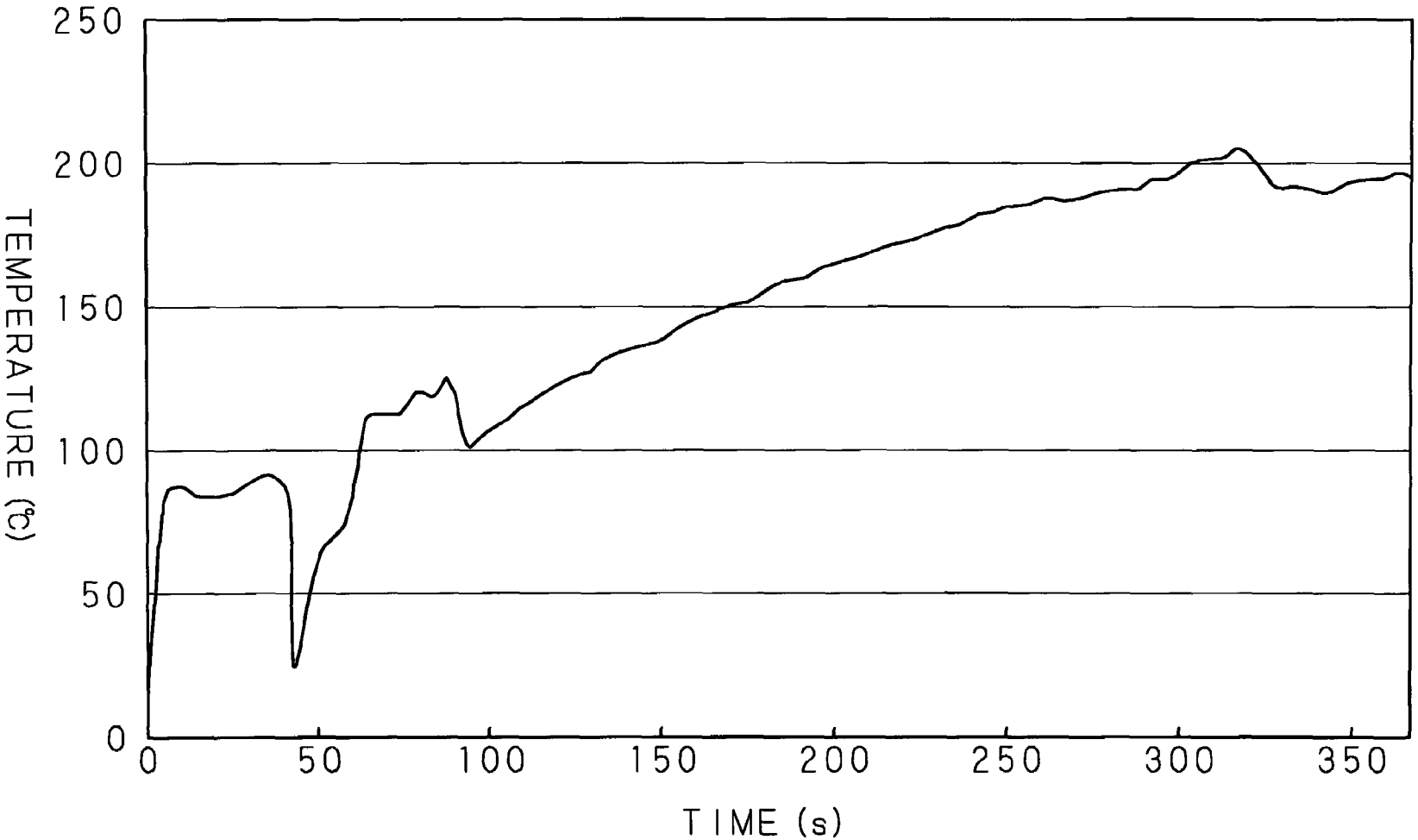
FIG. 3 RELATED ART
FIG. 3 is an explanatory view showing a measurement result of a surface temperature of a conventional heating roller.

FIG. 1 is a circuit diagram showing an example of a conventional temperature calculation circuit 200, FIG. 2 is a view showing an example of a conventional difference output waveform, and FIG. 3 is an explanatory view showing a measurement result of the surface temperature of the conventional heating roller 41*a*.

As shown in FIG. 1, in the temperature calculation circuit 200, a resistor 204 is connected in series to the infrared ray sensing thermistor 11, and the output voltage (sensor output Vc) of the infrared ray sensing thermistor 11 is taken out by a voltage follower circuit 203 formed by an operational amplifier. Similarly, a resistor 202 is connected in series to the compensation thermistor 12, and the output voltage (compensated output Vd) of the compensation thermistor 12 is taken out by a voltage follower circuit 201 formed by an operational amplifier. The resistors 202 and 204 are connected to a DC voltage (voltage of V1), respectively.

The sensor output Vc of the infrared ray sensing thermistor 11 and the compensated output Vd of the compensation thermistor 12 are inputted to a differential amplifying circuit 210 formed by an operational amplifier 214 and resistors 211, 212, 213, and 215. Resistance values of the resistors 211 and 213 are 20 kΩ, and resistance values of the resistors 212 and 215 are 100 kΩ, for example. Thus, the differential amplifying circuit 210 amplifies by five times a difference value (Vd−Vc) between the compensated output Vd and the sensor output Vc, and outputs the difference output (Vd−Vc)×5.

As shown in FIG. 2, a waveform of the difference output (Vd−Vc)×5 does not appear in the difference output because a component not higher than a ground level is removed from an AC component when the AC component (for example, a high frequency component such as a noise) is superimposed on a DC component and the DC component is near the ground level. Therefore, when the average value of the difference outputs is calculated for calculation of the surface temperature of the heating roller 41*a*, originally the AC component superimposed on the DC component is offset by averaging. However, only the component not higher than the ground level in the AC component is removed (or only the component not lower than the ground level in the AC component remains), and therefore, the average value of the difference outputs is increased as a whole than an original value. As is described in FIG. 6, when the compensated output Vd is constant and the difference output (Vd−Vc)×5 is increased, the surface temperature is increased.

As a result, as shown in FIG. 3, the surface temperature of the heating roller 41*a* is largely fluctuated at starting the fixing device 40, namely, at warming-up, thus generating error, and also generating error due to increase in the surface temperature up to about 200° C. which is higher than an actual surface temperature. As described above, the above problems can be solved.

Figure 7:
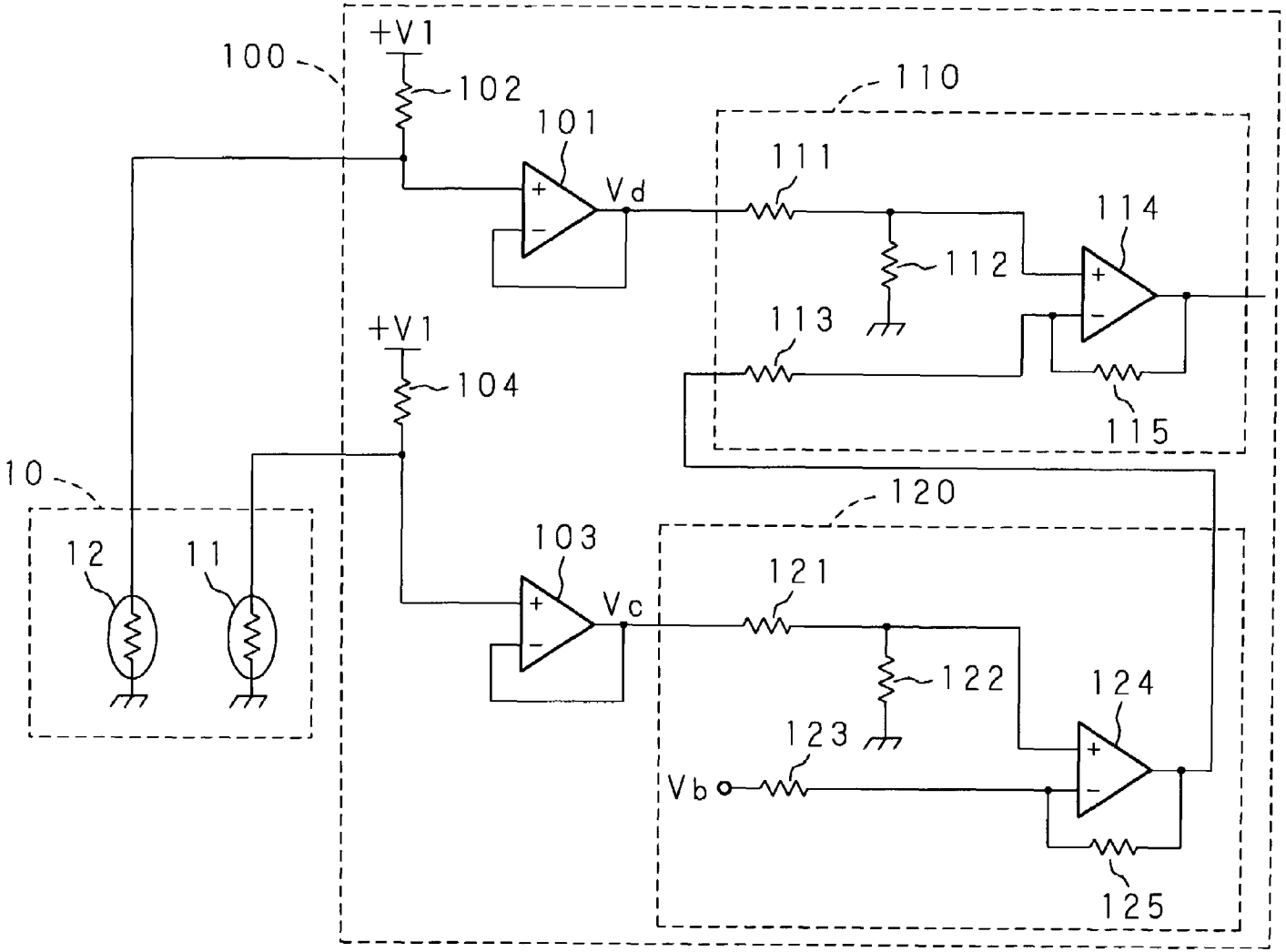
FIG. 7 is a circuit diagram showing an example of a temperature calculation circuit according to an embodiment.

FIG. 7 is a circuit diagram showing an example of the temperature calculation circuit 100 according to an embodiment. A resistor 104 is connected in series to the infrared ray sensing thermistor 11, and the output voltage (sensor output Vc) of the infrared ray sensing thermistor 11 is taken out by a voltage follower circuit 103 formed by an operational amplifier. Similarly, a resistor 102 is connected in series to the compensation thermistor 12, and the output voltage (compensated output Vd) of the compensation thermistor 12 is taken out by a voltage follower circuit 101 formed by an operational amplifier. The resistors 102 and 104 are connected to a DC voltage (voltage of V1), respectively.

The sensor output Vc and a bias voltage Vb taken out by the voltage follower circuit 103 are inputted to the noise removal prevention circuit 120 (differential amplifying circuit) including an operational amplifier 124, resistors 121, 122, 123, and 125 and the like. The bias voltage Vb is, for example, 0.2 V, and resistance values of the resistors 121, 122, 123, and 125 are, for example, 20 kΩ. Thus, the noise removal prevention circuit 120 outputs the difference voltage (Vc−Vb) between the sensor output Vc and the bias voltage Vb without amplifying to a differential amplifying circuit 110 in a post stage.

The compensated output Vd taken out by the voltage follower circuit 101 and the difference voltage (Vc−Vb) outputted from the noise removal prevention circuit 120 are inputted to the differential amplifying circuit 110 including an operational amplifier 114, resistors 111, 112, 113, and 115 and the like. The resistance values of the resistors 111 and 113 are, for example, 20 kΩ, and the resistance values of the resistors 112 and 115 are, for example, 100 kΩ. Thus, the differential amplifying circuit 110 amplifies by five times the difference value (Vd−Vc+Vb) between the compensated output Vd and the difference voltage (Vc−Vb) outputted from the noise removal prevention circuit 120, and outputs the difference output (Vd−Vc+Vb)×5. Note that the difference output outputted from the differential amplifying circuit 110 is averaged by an averaging circuit, then is converted from an analogue value into a digital value by an AD converter, and the converted digital value is outputted to the CPU 30.

The CPU 30 subtracts a value of five times as much as the bias voltage Vb from the difference output (Vd−Vc+Vb)×5 (more specifically, the digital value corresponding to Vd−Vc+Vb)×5) outputted from the differential amplifying circuit 110 (in this case, 1.0 V is subtracted because the bias voltage Vb is 0.2 V). Whereby, the difference output (Vd−Vc)×5 is extracted, and based on the extracted difference output (Vd−Vc)×5 and the compensated output Vd, the temperature conversion table is referenced, and the surface temperature of the heating roller 41*a* is obtained.

As described above, in a pre-stage of calculating the difference output, 0.2 V as the bias voltage Vb is subtracted from the sensor output Vc. By reducing the sensor output Vc by 0.2 V, the difference between the sensor output Vc and the compensated output Vd can be made larger by 1.0 V (the value of five times as much as 0.2 V). By performing the above-described processing, the component of the noise in a negative direction, which is conventionally removed, is not removed but appears as the difference output, thus preventing the average value of the difference outputs from increasing. By subtracting from the difference output the value of five times as much as the bias voltage, the difference output (Vd−Vc)×5 can be extracted.

Figure 8:
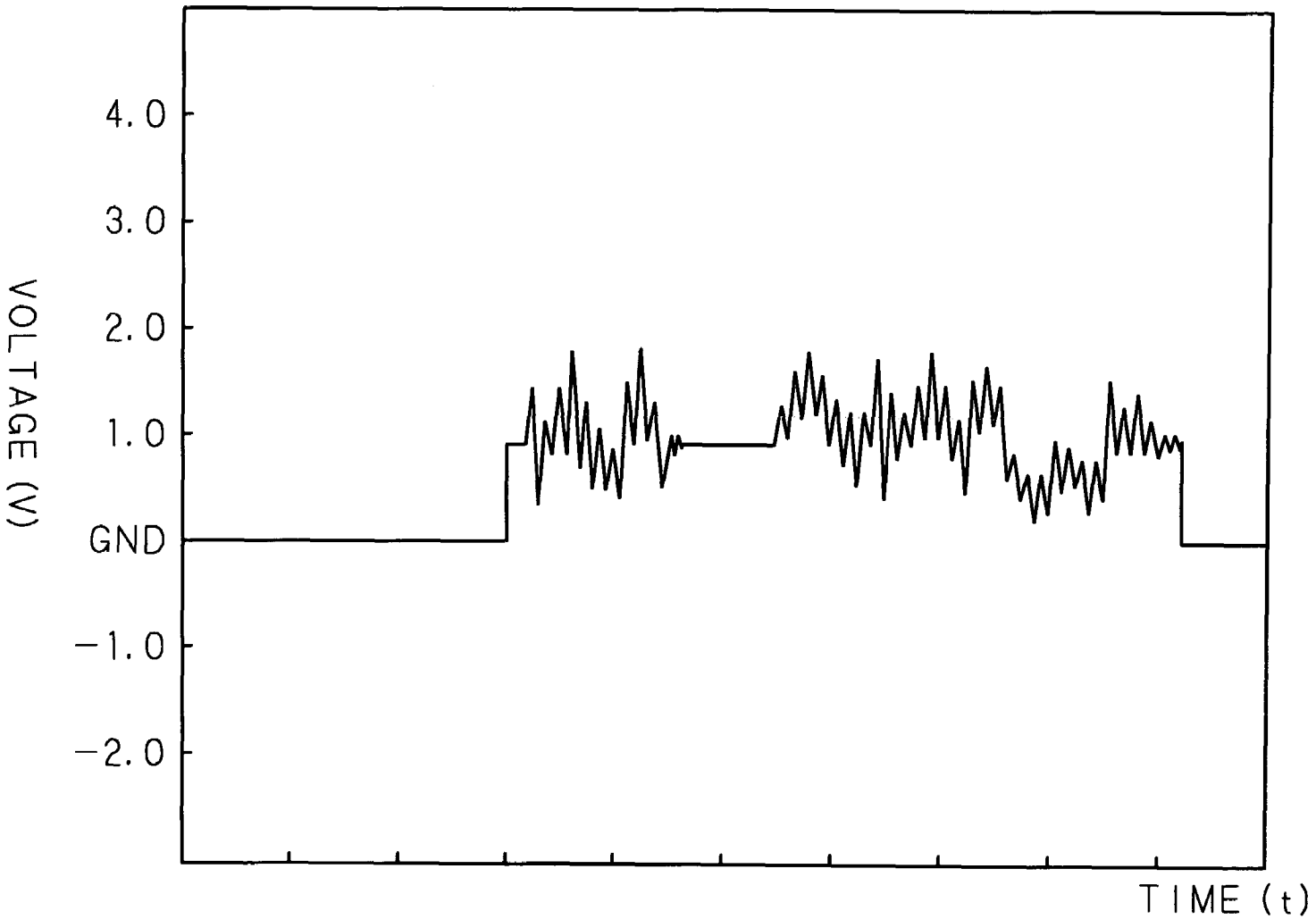
FIG. 8 is a view showing an example of a difference output waveform according to an embodiment.
Figure 9:
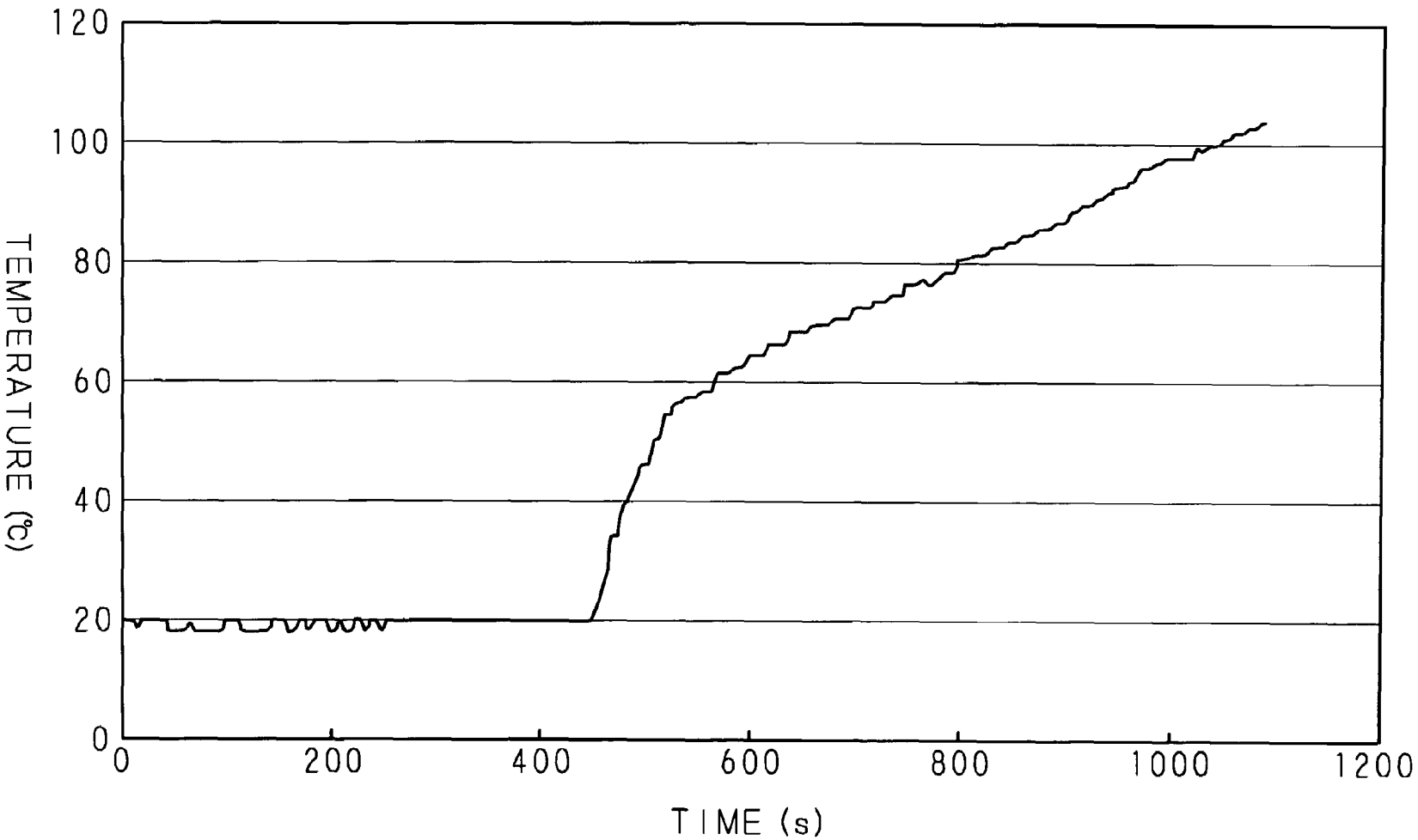
FIG. 9 is an explanatory view showing a measurement result of the surface temperature of the heating roller according to an embodiment.

FIG. 8 is a view showing an example of a difference output waveform according to an embodiment, and FIG. 9 is an explanatory view showing a measurement result of the surface temperature of the heating roller 41*a* according to an embodiment. As shown in FIG. 8, according to this embodiment, the difference output is (Vd−Vc+Vb)×5, while the conventional difference output is (Vd−Vc)×5. Therefore, the difference output becomes large by Vb×5, and the DC component can be made larger than the ground level by Vb×5. Accordingly, even when the AC component (for example, high frequency component such as a noise) is superimposed on the DC component of the difference output waveform, it is possible to prevent a part of the AC component from being removed. Therefore, when the average value of the difference outputs is obtained to calculate the surface temperature of the heating roller 41*a*, the AC component superimposed on the DC component is offset by averaging, the average value of the difference outputs can be accurately obtained, and the surface temperature of the heating roller 41*a* can be accurately calculated.

As a result, as shown in FIG. 9, the surface temperature of the heating roller 41*a* fluctuates with a stable value while error being reduced at starting the fixing device 40, namely, at warming-up. Also, the surface temperature is increased up to about 100° C., and the surface temperature can be calculated without error.

Second Embodiment

First Embodiment provides the structure of calculating the difference output by subtracting the bias voltage Vb from the sensor output Vc of the infrared ray sensing thermistor 11. However, calculation of the difference output is not limited thereto, and the bias voltage Vb can be added to the compensated output Vd of the compensation thermistor 12.

Figure 10:
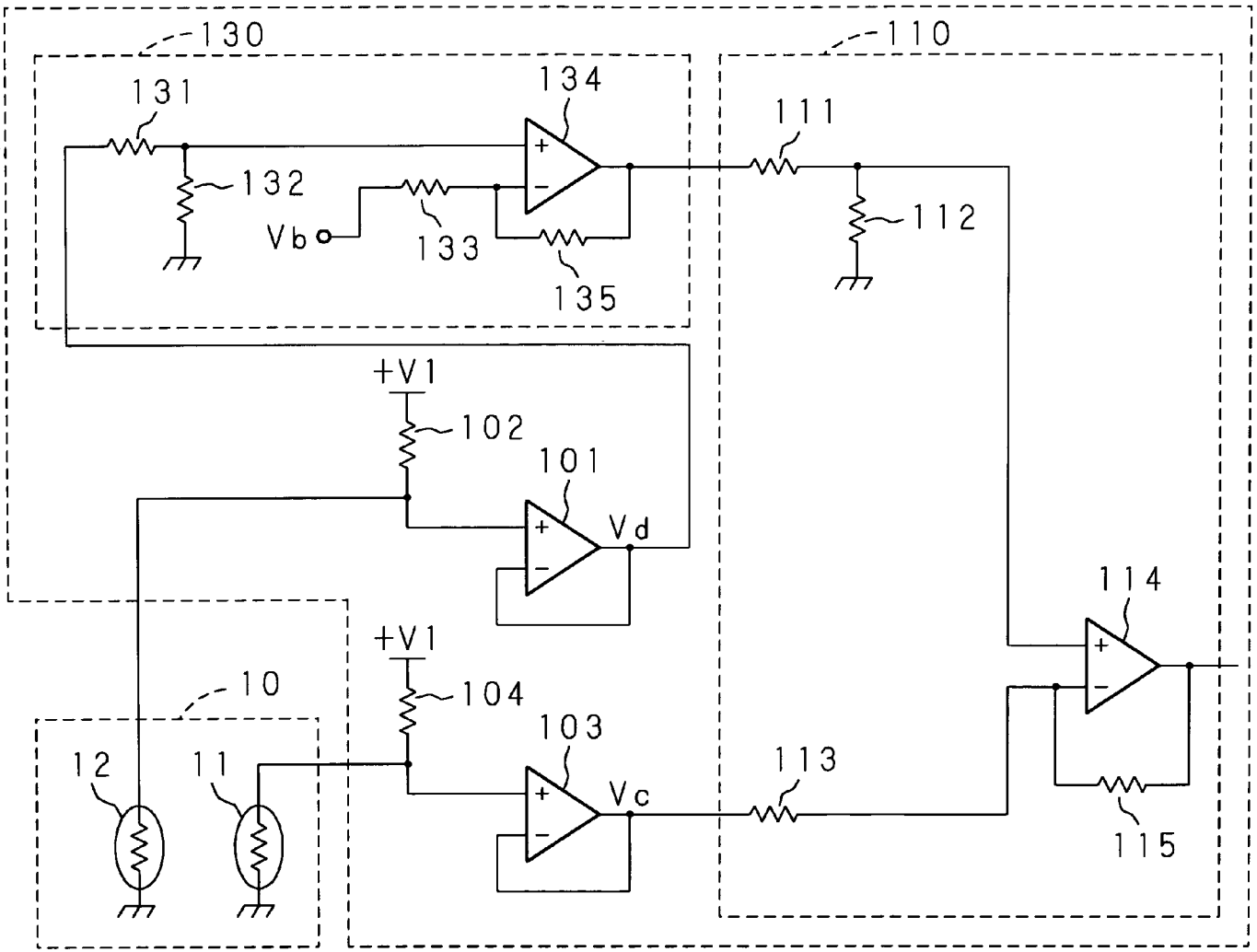
FIG. 10 is a circuit diagram showing an example of the temperature calculation circuit according to an embodiment.

FIG. 10 is a circuit diagram showing an example of the temperature calculation circuit 100 according to Second Embodiment. The resistor 104 is connected in series to the infrared ray sensing thermistor 11, and the output voltage (sensor output Vc) of the infrared ray sensing thermistor 11 is taken out by the voltage follower circuit 103 formed by the operational amplifier. Similarly, the resistor 102 is connected in series to the compensation thermistor 12, and the output voltage (compensated output Vd) of the compensation thermistor 12 is taken out by the voltage follower circuit 101 formed by the operational amplifier. The resistors 102 and 104 are connected to a DC voltage (voltage of V1), respectively.

The compensated output Vd and the bias voltage Vb taken out by the voltage follower circuit 101 are inputted to a noise removal prevention circuit 130 (differential amplifying circuit) including an operational amplifier 134, resistors 131, 132, 133, and 135, and the like. The bias voltage Vb is, for example, −0.2 V, and resistance values of the resistors 131, 132, 133, and 135 are, for example, 20 kΩ. Thus, the noise removal prevention circuit 130 outputs without amplifying the difference voltage (Vd−Vb) between the compensated output Vd and the bias voltage Vb to the differential amplifying circuit 110 in a post stage. Note that, in this case, since the bias voltage Vb is −0.2 V, 0.2 V is added to the compensated output Vd.

The sensor output Vc taken out by the voltage follower circuit 103 and the difference voltage (Vd−Vb) outputted from the noise removal prevention circuit 130 are inputted to the differential amplifying circuit 110 including the operational amplifier 114, the resistors 111, 112, 113, and 115, and the like. The resistance values of the resistors 111 and 113 are, for example, 20 kΩ, and the resistance values of the resistors 112 and 115 are, for example, 100 kΩ. Thus, the differential amplifying circuit 110 amplifies by five times the difference value (Vd−Vb−Vc) between the sensor output Vc and the difference voltage (Vd−Vb) outputted from the noise removal prevention circuit 130, and outputs the difference output (Vd−Vb−Vc)×5. Note that, in this case, since the bias voltage Vb is −0.2 V, the difference output is (Vd+0.2−Vc)×5. In addition, the difference output outputted from the differential amplifying circuit 110 is averaged by the averaging circuit, then is converted from an analog value into a digital value by the AD converter, and the converted digital value is outputted to the CPU 30.

The CPU 30 adds the value of five times as much as the bias voltage Vb, to the difference output (Vd−Vb−Vc)×5 (more specifically, the digital value corresponding to the difference output (Vd−Vb−Vc)×5) outputted from the differential amplifying circuit 110 (in this case, the bias voltage Vb is −0.2 V, and therefore −1.0 V is added, namely, 1.0 V is subtracted). Thus, the difference output (Vd−Vc)×5 is extracted, and based on the extracted difference output (Vd−Vc)×5 and the compensated output Vd, the temperature conversion table is referenced to obtain the surface temperature of the heating roller 41*a*.

In Second Embodiment, in a pre-stage of calculating the difference output, 0.2 V is added to the compensated output Vd (by subtracting the bias voltage Vb (−0.2 V), 0.2 V is consequently added). By increasing the compensated output Vd by 0.2 V, the difference between the difference output and the sensor output Vc can be made larger by 1.0 V (a value of five times as much as 0.2 V). By performing the above-described processing, the component of the noise in the negative direction, which is conventionally removed, is not removed but appears as the difference output, thus making it possible to prevent increase in the average value of the difference outputs. By subtracting from the difference output the value of five times as much as the bias voltage, the difference output (Vd−Vc)×5 can be extracted.

Third Embodiment

In First and Second Embodiments, by adding or subtracting a predetermined bias voltage Vb, the difference output (Vd−Vb−Vc)×5 is obtained. However, this is not limited thereto, and the difference output is increased or decreased in accordance with a size of the difference value (Vd−Vc), and thereby, the surface temperature of the heating roller 41*a* can be obtained with higher accuracy irrespective of the difference value (Vd−Vc).

Figure 11:
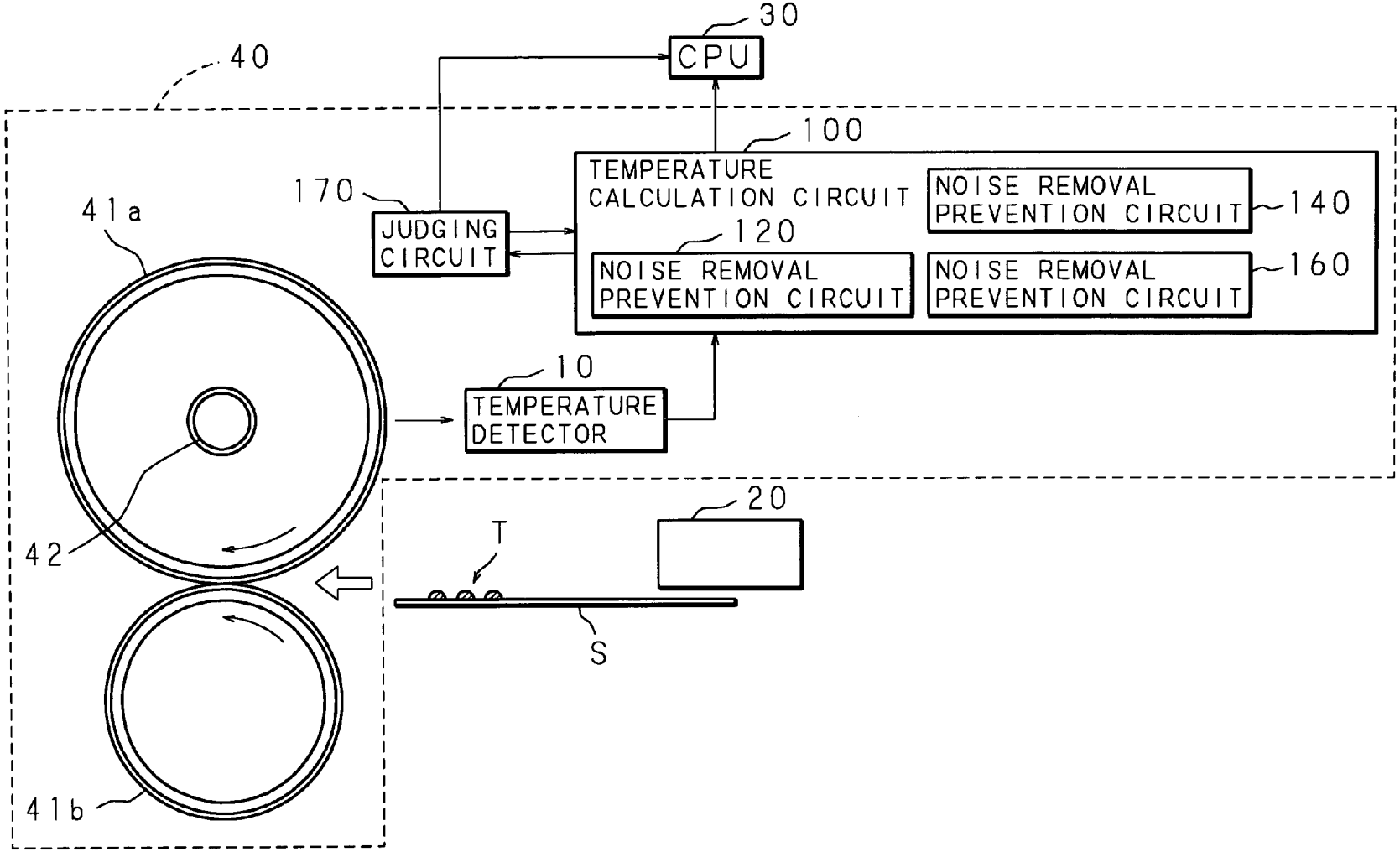
FIG. 11 is a schematic view showing the essential structure of the digital combined machine according to an embodiment.

FIG. 11 is a schematic view showing an essential structure of a digital combined machine according to Third Embodiment. Differences between First Embodiment and Third Embodiment are found in having noise removal prevention circuits 140 and 160 in the temperature calculation circuit 100, and having a discrimination circuit 170. The noise removal prevention circuits 140 and 160 are constituted in the same way as the noise removal prevention circuit 120. The discrimination circuit 170 outputs a predetermined discrimination result to the temperature calculation circuit 100 and the CPU 30 in accordance with the size of the difference value (Vd−Vc) between the compensated output Vd and the sensor output Vc. The temperature calculation circuit 100 and the discrimination circuit 170 according to Third Embodiment will be explained hereunder.

Figure 12:
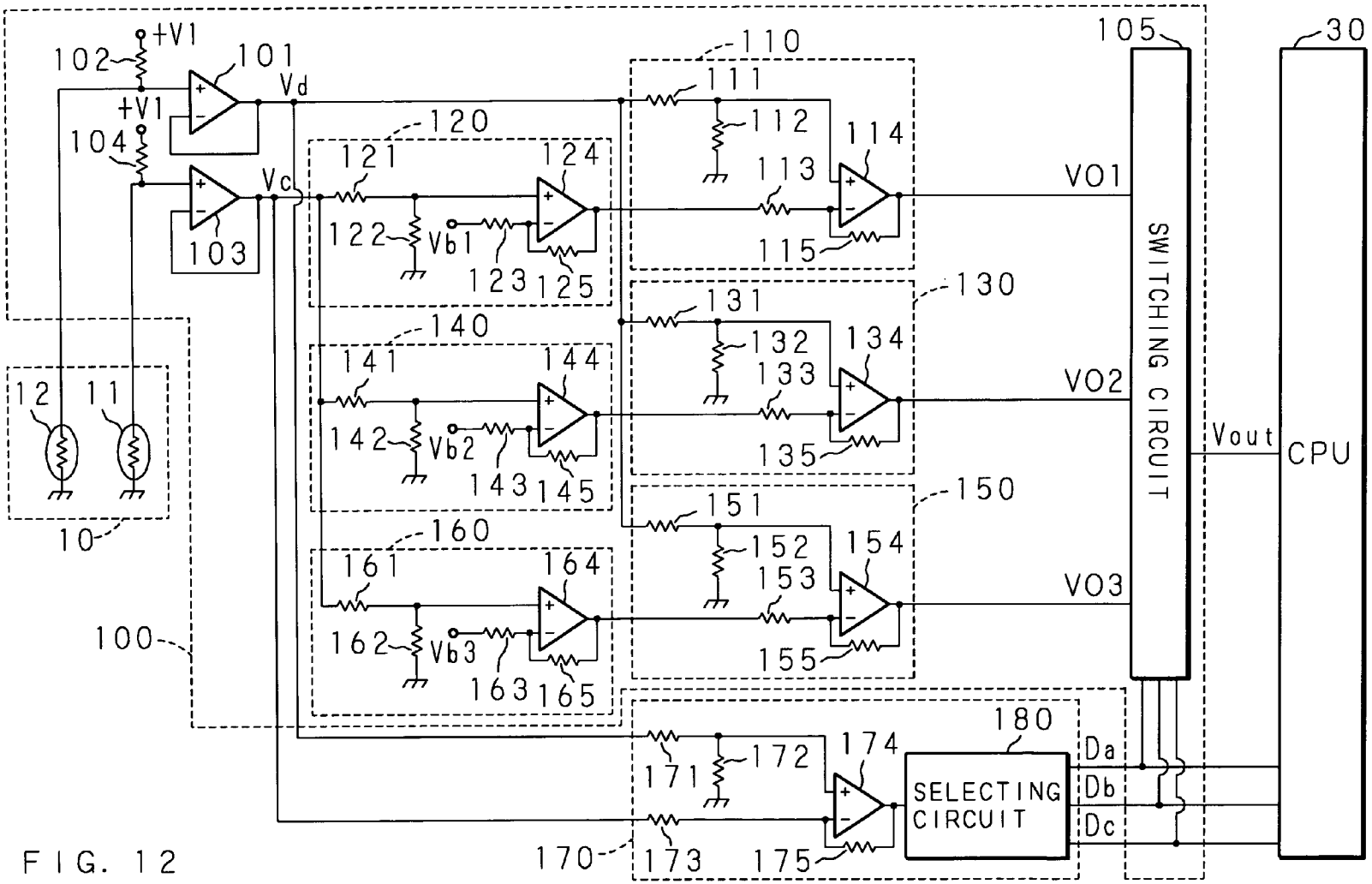
FIG. 12 is a circuit diagram showing an example of the temperature calculation circuit and a discrimination circuit.

FIG. 12 is a circuit diagram showing an example of the temperature calculation circuit 100 and the discrimination circuit 170. The resistor 104 is connected in series to the infrared ray sensing thermistor 11, and the output voltage (sensor output Vc) of the infrared ray sensing thermistor 11 is taken out by the voltage follower circuit 103 formed by the operational amplifier. Similarly, the resistor 102 is connected in series to the compensation thermistor 12, and the output voltage (compensated output Vd) of the compensation thermistor 12 is taken out by the voltage follower circuit 101 formed by the operational amplifier. The resistors 102 and 104 are connected to a DC voltage (voltage of V1), respectively.

The sensor output Vc and the bias voltage Vb1 taken out by the voltage follower circuit 103 are inputted to the noise removal prevention circuit 120 (differential amplifying circuit) including the operational amplifier 124, the resistors 121, 122, 123, and 125, and the like. The sensor output Vc and the bias voltage Vb2 taken out by the voltage follower circuit 103 are inputted to the noise removal prevention circuit 140 including an operational amplifier 144, resistors 141, 142, 143, and 145, and the like. The sensor output Vc and the bias voltage Vb3 taken out by the voltage follower circuit 103 are inputted to a noise removal prevention circuit 160 including an operational amplifier 164, resistors 161, 162, 163, and 165, and the like.

The sensor output Vc taken out by the voltage follower circuit 103 and the compensated output Vd taken out by the voltage follower circuit 101 are inputted to a discrimination circuit 170 including an operational amplifier 174, resistors 171. 172, 173, and 175, a selection circuit 180, and the like. For example, values of the resistors 171, 172, 173, and 175 are 20 kΩ, and thus the difference value (Vd−Vc) is outputted to the selection circuit 180 without being amplified.

Values of the bias voltages Vb1, Vb2, and Vb3 are, for example, 0.2 V, 0 V, and −0.2 V, respectively, and values of the resistors 121, 122, 123, 125, 141, 142, 143, 145, 161, 162, 163, and 165 are, for example, 20 kΩ. Thus, the noise removal prevention circuit 120 outputs without amplifying the difference voltage (Vc−Vb1) between the sensor output Vc and the bias voltage Vb1 to the differential amplifying circuit 110 in a post stage. The noise removal prevention circuit 124 outputs without amplifying the difference voltage (Vc−Vb2) between the sensor output Vc and the bias voltage Vb2 to the differential amplifying circuit 110 in the post stage. The noise removal prevention circuit 160 outputs without amplifying the difference voltage (Vc−Vb3) between the sensor output Vc and the bias voltage Vb3 to the differential amplifying circuit 110 in the post stage.

The compensated output Vd taken out by the voltage follower circuit 101 and the difference voltage (Vc−Vb1) outputted from the noise removal prevention circuit 120 are inputted to the differential amplifying circuit 110 including the operational amplifier 114, and the resistors 111, 112, 113, and 115. The compensated output Vd taken out by the voltage follower circuit 101 and the difference voltage (Vc−Vb2) outputted from the noise removal prevention circuit 140 are inputted to the differential amplifying circuit 130 including the operational amplifier 134, and the resistors 131, 132, 133, and 135. The compensated output Vd taken out by the voltage follower circuit 101 and the difference voltage (Vc−Vb3) outputted from the noise removal prevention circuit 160 are inputted to a differential amplifying circuit 150 including an operational amplifier 154, and resistors 151, 152, 153, and 155.

Resistance values of the resistors 111, 113, 131, 133, 151, and 153 are, for example, 20 kΩ, and resistance values of the resistors 112, 115, 132, 135, 152, and 155 are, for example, 100 kΩ. Thus, the differential amplifying circuit 110 amplifies by five times the difference value (Vd−Vc+Vb1) between the compensated output Vd and the difference voltage (Vc−Vb1) outputted from the noise removal prevention circuit 120, and outputs a difference output VO1: (Vd−Vc+Vb1)×5 to a switching circuit 105. The differential amplifying circuit 130 amplifies by five times the difference value (Vd−VC+Vb2) between the compensated output Vd and the difference voltage (Vc−Vb2) outputted from the noise removal prevention circuit 140, and outputs a difference output VO2: (Vd−Vc+Vb2)×5 to the switching circuit 105. The differential amplifying circuit 150 amplifies by five times the difference value (Vd−Vc+Vb3) between the compensated output Vd and the difference voltage (Vc−Vb3) outputted from the noise removal prevention circuit 160, and outputs a difference output VO3: (Vd−Vc+Vb3)×5 to the switching circuit 105.

Figure 13:
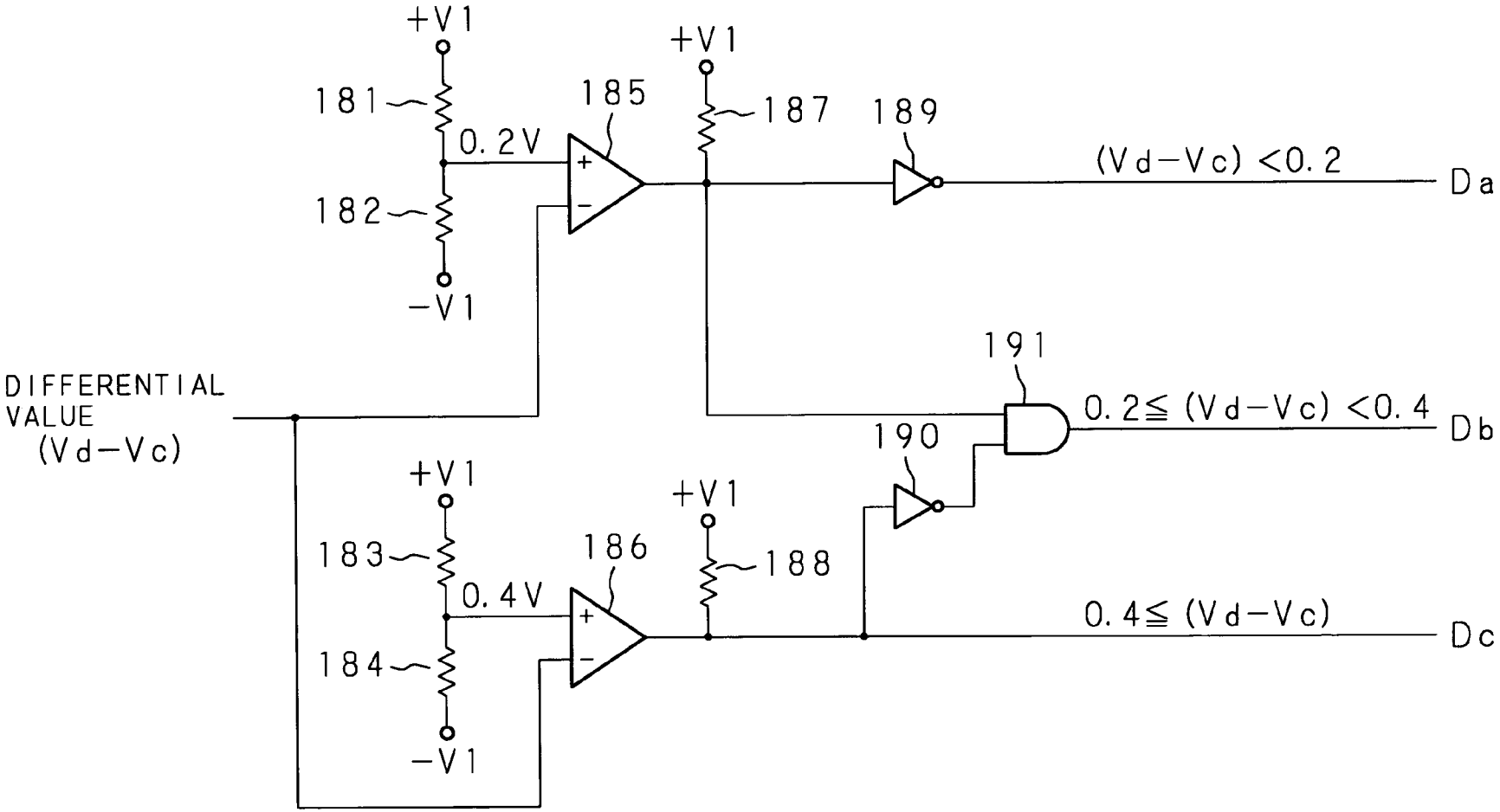
FIG. 13 is a circuit diagram showing an example of a selection circuit.

FIG. 13 is a circuit diagram showing an example of the selection circuit 180. The selection circuit 180 divides a range of the inputted difference value (Vd−Vc) into three regions, and in accordance with a size of the difference value (Vd−Vc), outputs a high level signal (such as "1") from any one of three output terminals Da, Db, and Dc. For example, the region of the difference value (Vd−Vc) is divided into three regions with 0.2 V and 0.4 V as boundary values. Therefore, the selection circuit 180 includes resistors 181 and 182 for generating the boundary value of 0.2 V, resisters 183 and 184 for generating the boundary value of 0.4 V, comparators 185 and 186, inverter circuits 189 and 190, an AND circuit 191, and the like.

The voltage of 0.2 V is inputted to a (+) terminal of the comparator 185, and the difference value (Vd−Vc) is inputted to a (−) terminal. When the difference value (Vd−Vc) is 0.2 V or more, the comparator 185 outputs the high level signal. Thus, when the difference value (Vd−Vc) is less than 0.2 V, the inverter circuit 189 outputs the high level signal through the output terminal Da.

The voltage of 0.4 V is inputted to a (+) terminal, and the difference value (Vd−Vc) is inputted to a (−) terminal of the comparator 186. When the difference value (Vd−Vc) is 0.4 V or more, the comparator 186 outputs the high level signal to the output terminal Dc and the inverter circuit 190. Thus, when the difference value (Vd−Vc) is 0.4 V or more, the high level signal is outputted from the output terminal Dc. The output from the comparator 185 and the output from the inverter circuit 190 are inputted to the AND circuit 191. Therefore, when the difference value (Vd−Vc) is 0.2 V or more and less than 0.4 V, the AND circuit 191 outputs the high level signal through the output terminal Db. Note that the above boundary values (0.2 V and 0.4 V) are examples, and these values can be suitably set in accordance with characteristics of the fixing device 40, the heating roller 41*a*, and the like.

Figure 14A:
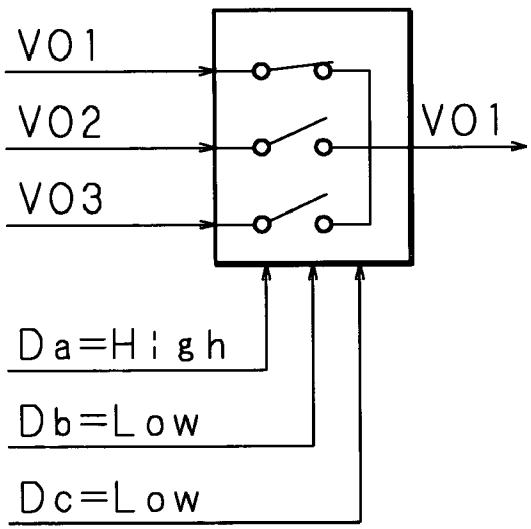
FIGS. 14A to 14C are explanatory views showing an example of operation of a switching circuit.
Figure 14B:
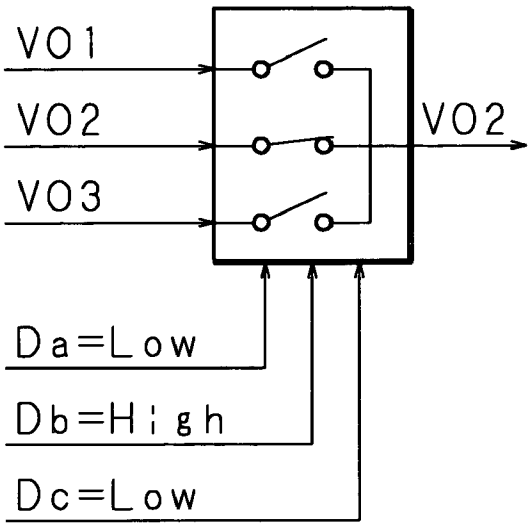
Figure 14C:
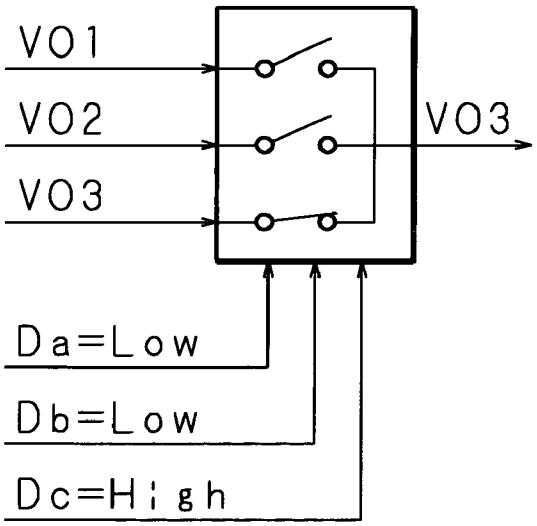

FIGS. 14A to 14C are explanatory views showing an example of an operation of the switching circuit 105. The difference output VO1, VO2, and VO3 from the differential amplifying circuits 110. 130, and 150, and the outputs Da, Db, and Dc from the discrimination circuit 180 are inputted to the switching circuit 105. As shown in FIG. 14A, when the output Da has a high level, the difference output VO1 is averaged by the averaging circuit (not shown) and then is converted from an analog value into a digital value by the AD converter (not shown), and a converted digital value Vout is outputted to the CPU 30. Also, as shown in FIG. 14B, when the output Db has a high level, the difference output VO2 is averaged by the averaging circuit (not shown) and then is converted from an analog value into a digital value by the AD converter (not shown), and the converted digital value Vout is outputted to the CPU 30. Also, as shown in FIG. 14C, when the output Dc has a high level, the difference output VO3 is averaged by the averaging circuit (not shown) and then is converted from an analog value into a digital value by the AD converter (not shown), and the converted digital value Vout is outputted to the CPU 30.

From the output Vout outputted from the switching circuit 105 (more specifically, the digital value corresponding to the difference output (Vd−Vc+Vb)×5, wherein Vb is any one of Vb1, Vb2, and Vb3), the CPU 30 subtracts a value of five times as much as the bias voltage Vb1 from the output Vout when the output Da has a high level (in this case, the bias voltage Vb1 is 0.2 V, and therefore 1.0 V is subtracted), based on the outputs Da, Db, and Dc outputted from the discrimination circuit 170. When the output Db has a high level, the CPU 30 subtracts a value of five times as much as the bias voltage Vb2 from the output Vout (in this case, the bias voltage Vb2 is 0 V, and therefore nothing is done as a result). When the output Dc has a high level, the CPU 30 subtracts a value of five times as much as the bias voltage Vb3 from the output Vout (in this case, the bias voltage Vb3 is −0.2 V, and therefore −1.0 V is subtracted). Thus, the CPU 30 extracts the difference output (Vd−Vc)×5, and based on the extracted difference output (Vd−Vc)×5 and the compensated output Vd, the temperature conversion table is referenced to obtain the surface temperature of the heating roller 41*a*.

As described above, in the pre-stage of calculating the difference output, 0.2 V as the bias voltage Vb1, 0 V as the bias voltage Vb2, or −0.2 V as the bias voltage Vb3 is subtracted from the sensor output Vc. By reducing the sensor output Vc by 0.2 V, 0 V, or −0.2 V, the difference between the sensor output Vc and the compensated output Vd can be increased by 1.0 V, 0 V, or −1.0 V (a value of five times as much as the bias voltage). By performing the above-described processing, the component of the noise in the negative direction, which is conventionally removed, or the component in the positive direction is not removed but appears as the difference output, thus making it possible to prevent increase in the average value of the difference outputs irrespective of the size of the difference value (Vd−Vc). In accordance with the outputs Da, Db, and Dc from the discrimination circuit 170, the difference output used in the temperature conversion table can be selected. By subtracting the value of five times as much as the bias voltage from the difference output, the difference output (Vd−Vc)×5 can be extracted.

Figure 15:
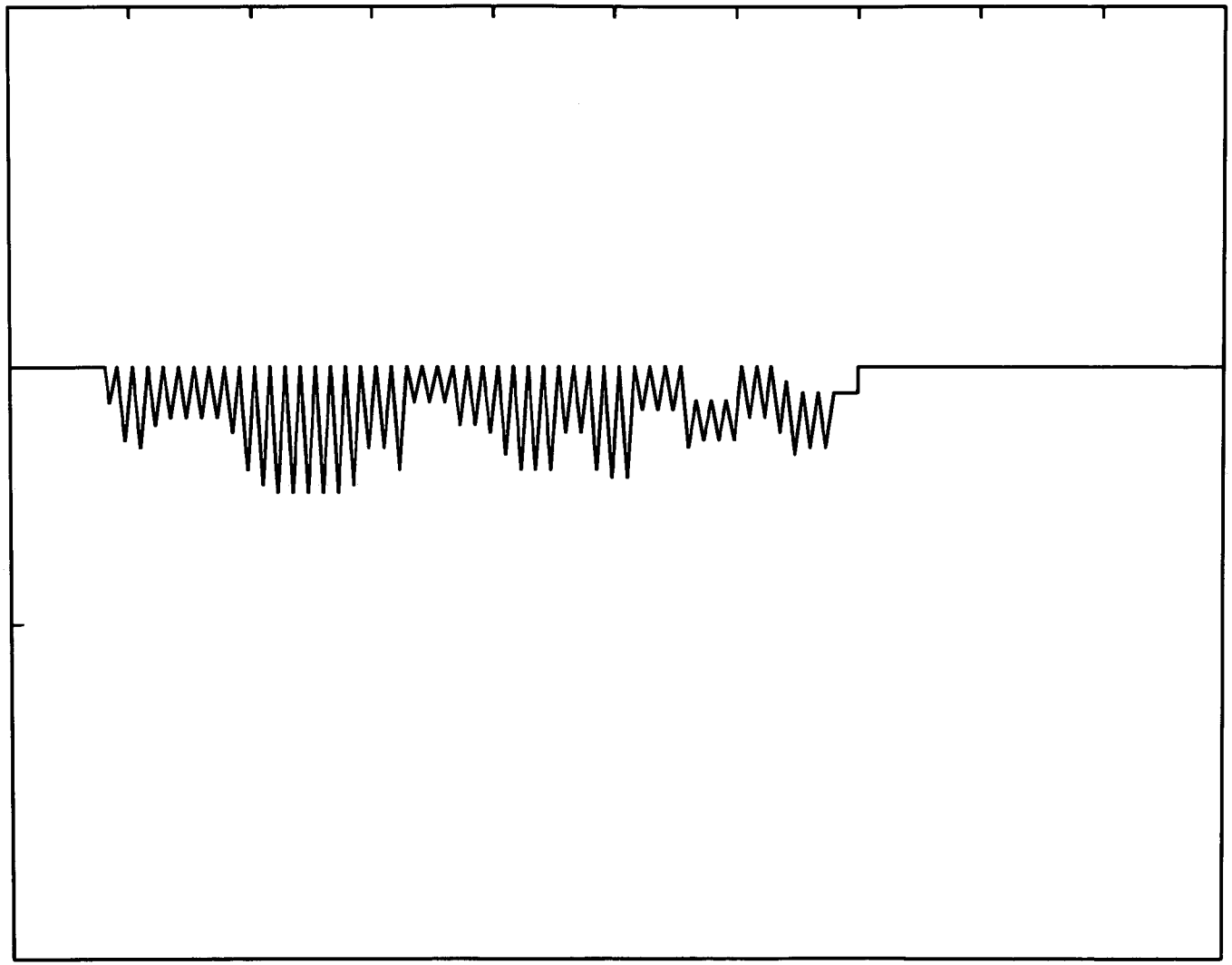
FIG. 15 is a view showing an example of the conventional difference output waveform.

FIG. 15 is a view showing an example of the conventional difference output waveform. As shown in FIG. 15, when the AC component (for example, a high frequency component such as a noise) is superimposed on the DC component and the DC component is near a maximum amplifying voltage level, the waveform of the difference output (Vd−Vc)×5 does not appear in the difference output because the component not lower than the maximum amplifying voltage level in the AC component is removed. Therefore, when the average value of the difference outputs is calculated to calculate the surface temperature of the heating roller 41*a*, the AC component superimposed on the DC component is originally offset by averaging. However, only the component not lower than the maximum amplifying voltage level in the AC component is removed (or only the component not higher than the maximum amplifying voltage level in the AC component remains), and therefore the average value of the difference outputs is reduced as a whole than an original value. In this case, as described in FIG. 6, when the compensated output Vd is constant and the difference output (Vd−Vc)×5 is decreased, the surface temperature is decreased than an actual value. As a result, in the same way as shown in FIG. 3, the surface temperature of the heating roller 41*a* allows an error to occur. According to Third Embodiment, not only in a case where the DC component is near the ground level but also in a case where the DC component is near the maximum amplifying voltage level, a sensing error of the surface temperature of the heating roller 41*a* is reduced.

Figure 16:
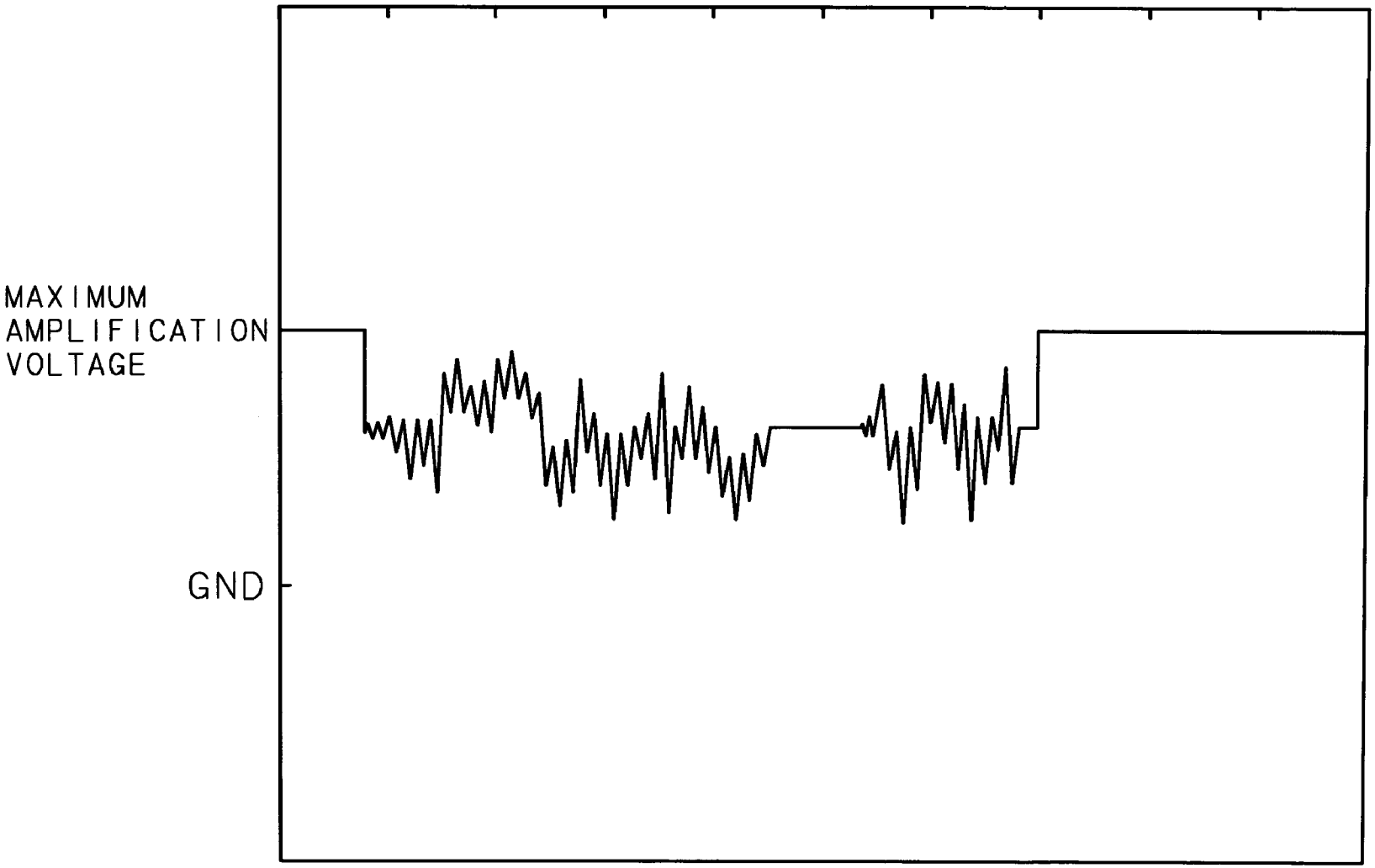
FIG. 16 is a view showing an example of the difference output waveform according to an embodiment.

FIG. 16 is a view showing an example of the difference output waveform according to an embodiment. In Third Embodiment, when the difference value (Vd−Vc) is less than 0.2 V, the difference output is (Vd−Vc+Vb 1)×5, and therefore the difference output becomes larger by a value of Vb1×5 (such as 1.0 V in a case where Vb1=0.2 V), and the DC component can be made larger than the ground level by Vb1×5. Accordingly, even when the AC component (for example, a high frequency component such as a noise) is superimposed on the DC component of the difference output waveform, it is possible to prevent a part of the AC component from being removed. Therefore, when the average value of the difference outputs is obtained to calculate the surface temperature of the heating roller 41*a*, the AC component superimposed on the DC component is offset by averaging, and the average value of the difference outputs can be obtained with accuracy, thus making it possible to calculate the surface temperature of the heating roller 41*a* accurately. This is the same as in First Embodiment, and the same as the example shown in FIG. 8.

Further, when the difference value (Vd−Vc) is 0.2 V or more and less than 0.4, the difference output is (Vd−Vc+Vb2)×5, and therefore the difference output becomes larger by a value of Vb2×5 (for example, 0 V in a case where Vb2=0 V) and substantially the DC component is not offset. Accordingly, even when the AC component (for example, a high frequency component such as a noise) is superimposed on the DC component of the difference output waveform, it is possible to prevent a part of the AC component from being removed.

Further, when the difference value (Vd−Vc) is 0.4 V or more, the difference output is (Vd−Vc+Vb3)×5. Therefore, as shown in FIG. 16, the difference output becomes larger by a value of Vb3×5 (such as −1.0 V in a case where Vb3=−0.2 V), thus making it possible to make the DC component larger by −1.0 V (namely, the DC component is reduced by 1.0 V). Accordingly, even when the AC component is superimposed on the DC component of the difference output waveform (for example, a high frequency component such as a noise), it is possible to prevent e a part of the AC component (such as the component of not lower than the maximum amplifying voltage level) from being removed. Therefore, when the average value of the difference outputs is obtained to calculate the surface temperature of the heating roller 41*a*, the AC component superimposed on the DC component is offset by averaging, and the average value of the difference outputs can be obtained accurately, thus making it possible to calculate the surface temperature of the heating roller 41*a* accurately. As a result, in the same way as in First Embodiment, as shown in FIG. 9, the surface temperature of the heating roller 41*a* fluctuates with a stable value with decrease in error at starting the fixing device 40, namely, at warming-up, the surface temperature is increased up to about 100° C., and therefore the surface temperature can be calculated without error.

FIGS. 17A to 17C are explanatory views showing an example of removal prevention of the AC component superimposed on the difference value (Vd−Vc). In FIGS. 17A to 17C, 3.3 V is defined as the maximum amplifying voltage level as an example. As shown in FIG. 17A, when the DC component in the difference value (Vd−Vc) is large (such as a value near the maximum amplifying voltage level), the bias value of the DC component is reduced, to thereby prevent the AC component (in the positive direction) superimposed on the DC component from being removed. In addition, as shown in FIG. 17B, when the DC component in the difference value (Vd−Vc) is near an intermediate level between the ground level and the maximum amplifying voltage level, no bias is applied to the DC component and the DC component as it is, is outputted. In addition, as shown in FIG. 17C, when the DC component in the difference value (Vd−Vc) is small (such as a value near the ground level), the AC component (in the negative direction) superimposed on the DC component is prevented from being removed by increasing the bias value of the DC component.

As described above, in this disclosure, sensing error of the surface temperature of the heating roller can be reduced with a simple structure. Further, even when the output of the compensation thermistor is in the vicinity of the an amplification limit value and an output value cannot be increased, namely, when no bias value can be added to the compensated output Vd, bias can be applied to the sensor output Vc. Further, even when the output of the infrared ray sensing thermistor is in the vicinity of the ground level and the output value cannot be reduced, namely, when no bias value can be added to the sensor output Vc, bias can be applied to the compensated output Vd, and the surface temperature of the heating roller can be accurately calculated. Further, the bias value to be used can be selected based on the difference value (Vd−Vc), and therefore, even when the difference value (Vd−Vc) is in the vicinity of the maximum amplifying voltage level or in the vicinity of the ground level, the surface temperature of the heating roller can be accurately calculated. In addition, even when there is no necessity of applying bias, the description is applicable.

A circuit structure and a circuit constant shown in above-described First to Third Embodiments are given as examples, and the embodiments are not limited thereto. For example, instead of the amplification circuit of one stage, the amplification circuit of multiple stages may be used.

In above-described First to Third Embodiments, the CPU 30 is separated from the fixing device 40. However, the CPU 30 may be included in the fixing device 40.

In above-described First to Third Embodiments, the temperature calculation circuit is constituted by hardware such as the voltage follower circuit and the differential amplifying circuit. However, the scope is not limited thereto, and the embodiments can also be realized by constituting a function of the temperature calculation circuit by a temperature calculation processing program and the like, and executing such a program by the CPU.

In above-described Third Embodiment, the noise removal prevention circuits 120, 140, and 160, and the differential amplifying circuits 110, 130, and 150 are provided, and the differential value (Vd−Vc) is divided into three voltage regions. However, the number of division of the voltage region of the difference value is not limited to three, and it may be 2, 4 or more.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. A fixing device including a heating roller, for heating a sheet having an image transferred thereon by a developer and fixing the image onto the sheet, the device comprising:

a first sensor for sensing a temperature due to radiation from the heating roller;

a second sensor for sensing an ambient temperature of the first sensor;

a difference calculation part for calculating a difference between outputs of the first sensor and the second sensor;

a removal prevention part for preventing removal of an AC component of the difference from the difference calculated by the difference calculation part; and a temperature calculation part for calculating a surface temperature of the heating roller based on the difference calculated by the difference calculation part.

2. The fixing device according to claim 1, further comprising an offset part for offsetting a DC component of the difference calculated by the difference calculation part.

3. The fixing device according to claim 2, further comprising a subtraction part for subtracting a predetermined value from an output of the first sensor, wherein the difference calculation part calculates a difference between an output of the second sensor and an output subtracted by the subtraction part; and the offset part offsets the DC component based on the difference calculated by the difference calculation part.

4. The fixing device according to claim 2, further comprising an addition part for adding a predetermined value to an output of the second sensor, wherein the difference calculation part calculates a difference between the output of the second sensor and an output added by the addition part; and the offset part offsets the DC component based on the difference calculated by the difference calculation part.

5. The fixing device according to claim 2, further comprising a control part for controlling an increase/decrease in the DC component offset by the offset part in accordance with a size of the difference calculated by the difference calculation part.

6. The fixing device according to claim 2, wherein a plurality of the offset parts are provided, and each of the offset parts offsets the DC component with a value different from one another, and the fixing device further comprises:

a selection part for selecting any one of the plurality of the offset parts in accordance with a size of the difference calculated by the difference calculation part; and a control part for controlling an increase/decrease in the DC component in the offset part selected by the selection part.

7. The fixing device according to claim 1, further comprising an average value calculation part for calculating an average value of the differences calculated by the difference calculation part, wherein the temperature calculation part calculates the surface temperature of the heating roller based on the average value calculated by the average value calculation part.

8. A fixing device including a heating roller, for heating a sheet having an image transferred thereon by a developer and fixing the image onto the sheet, the device comprising:

a first sensor for sensing a temperature due to radiation from the heating roller;

a second sensor for sensing an ambient temperature of the first sensor; and a control part capable of performing operations of:

calculating a difference between outputs of the first sensor and the second sensor;

preventing removal of an AC component of the difference from the calculated difference; and calculating a surface temperature of the heating roller based n the calculated difference.

9. The fixing device according to claim 8, wherein the control part is further capable of performing an operation of offsetting a DC component of the calculated difference.

10. The fixing device according to claim 9, wherein the control part is further capable of performing operations of subtracting a predetermined value from an output of the first sensor;

calculating a difference between an output of the second sensor and the subtracted output; and offsetting the DC component based on the calculated difference.

11. The fixing device according to claim 9, wherein the control part is further capable of performing operations of adding a predetermined value to the output of the second sensor;

calculating a difference between the output of the second sensor and the added output; and offsetting the DC component based on the calculated difference.

12. The fixing device according to claim 9, wherein the control part is further capable of performing an operation of controlling an increase/decrease in the DC component offset by the offset part in accordance with a size of the calculated difference.

13. The fixing device according to claim 9, wherein the control part is further capable of performing operations of selecting any one of a plurality of offset values used to offset the DC component, in accordance with a size of the calculated difference; and offsetting the DC component with the selected offset value.

14. The fixing device according to claim 1, wherein the control part is further capable of performing operations of calculating an average value of the calculated differences; and calculating the surface temperature of the heating roller based on the calculated average value.

15. An image forming apparatus, comprising the fixing device according to claim 1, wherein the image is formed by fixing the image onto the sheet with the fixing device.

16. An image forming apparatus, comprising:

the fixing device according to claim 1; and a control part for controlling the temperature of the heating roller based on the surface temperature of the heating roller calculated by the temperature calculation part, wherein the image is formed by fixing the image onto the sheet with the fixing device.

17. An image forming apparatus, comprising the fixing device according to claim 8, wherein the image is formed by fixing the image onto the sheet with the fixing device.

18. An image forming apparatus, comprising:

the fixing device according to claim 8; and a control part for controlling the temperature of the heating roller based on the calculated surface temperature of the heating roller, wherein the image is formed by fixing the image onto the sheet with the fixing device.

19. A fixing device including a heating roller, for heating a sheet having an image transferred thereon by a developer and fixing the image onto the sheet, the device comprising:

first sensing means for sensing a temperature due to radiation from the heating roller;

second sensing means for sensing an ambient temperature of the first sensing means;

difference calculation means for calculating a difference between outputs of the first sensing means and the second sensing means;

removal prevention means for preventing removal of an AC component of the difference from the difference calculated by the difference calculation means; and temperature calculation means for calculating a surface temperature of the heating roller based on the difference calculated by the difference calculation means.

* * * * *